US007093445B2

(12) United States Patent
Corr, II et al.

(10) Patent No.: US 7,093,445 B2
(45) Date of Patent: Aug. 22, 2006

(54) FUEL-AIR PREMIXING SYSTEM FOR A CATALYTIC COMBUSTOR

(75) Inventors: Robert Anthony Corr, II, El Cajon, CA (US); Tim Caron, Mountain View, CA (US); John Barnes, Niskayuna, NY (US)

(73) Assignee: Catalytica Energy Systems, Inc., Mountain View, CA (US)

( * ) Notice: Subject to any disclaimer, the term of this patent is extended or adjusted under 35 U.S.C. 154(b) by 239 days.

(21) Appl. No.: 10/350,697

(22) Filed: Jan. 23, 2003

(65) Prior Publication Data

US 2004/0021235 A1 Feb. 5, 2004

Related U.S. Application Data

(60) Provisional application No. 60/384,497, filed on May 31, 2002.

(51) Int. Cl.
*F02C 1/00* (2006.01)

(52) U.S. Cl. ..... 60/777; 60/723; 60/737; 60/748

(58) Field of Classification Search ..... 60/737, 60/748, 751, 723, 777
See application file for complete search history.

(56) References Cited

U.S. PATENT DOCUMENTS

| | | | | |
|---|---|---|---|---|
| 2,687,614 A | | 8/1954 | Goddard | |
| 3,217,488 A | | 11/1965 | Von Chain et al. | |
| 3,393,984 A | | 7/1968 | Wisman | |
| 3,703,800 A | | 11/1972 | Courbon | |
| 3,847,125 A | | 11/1974 | Malherbe | |
| 3,975,900 A | | 8/1976 | Pfefferle | |
| 4,215,536 A | | 8/1980 | Rudolph | |
| 4,490,973 A | | 1/1985 | Kinsey | |
| 4,589,260 A | * | 5/1986 | Krockow | 60/737 |
| 4,715,346 A | | 12/1987 | Dempsey | |
| 4,899,539 A | | 2/1990 | Gastebois et al. | |
| 5,165,241 A | | 11/1992 | Joshi et al. | |
| 5,193,346 A | * | 3/1993 | Kuwata et al. | 60/737 |
| 5,251,447 A | | 10/1993 | Joshi et al. | |
| 5,256,352 A | | 10/1993 | Snyder et al. | |
| 5,284,019 A | | 2/1994 | Vdoviak | |
| 5,450,724 A | | 9/1995 | Kesseli et al. | |
| 5,511,375 A | | 4/1996 | Joshi et al. | |
| 5,590,529 A | | 1/1997 | Joshi et al. | |
| 5,596,873 A | | 1/1997 | Joshi et al. | |
| 5,603,211 A | | 2/1997 | Graves | |
| 5,613,363 A | | 3/1997 | Joshi et al. | |
| 5,622,054 A | | 4/1997 | Tingle | |
| 5,660,044 A | * | 8/1997 | Bonciani et al. | 60/737 |
| 5,675,971 A | | 10/1997 | Angel et al. | |
| 5,680,766 A | | 10/1997 | Joshi et al. | |

(Continued)

OTHER PUBLICATIONS

International Search Report mailed on Sep. 11, 2003, for PCT patent application No. PCT/US03/17415 filed on May 30, 2003, 3 pages.

(Continued)

*Primary Examiner*—Charles G. Freay
(74) *Attorney, Agent, or Firm*—Morrison & Foerster LLP

(57) ABSTRACT

Disclosed is a unique fuel and air premixing system for a gas turbine catalytic combustion system. The mixer utilizes a multi-channel counter-rotating swirler with aerodynamically shaped fuel pegs located upstream of the swirler. The premixing system provides the downstream catalyst with a fuel-air mixture sufficiently uniform for proper catalyst operation and wide operating limits. Features have been incorporated in the system to make it resistant to flameholding.

36 Claims, 14 Drawing Sheets

U.S. PATENT DOCUMENTS

| | | | | |
|---|---|---|---|---|
| 5,778,676 | A | 7/1998 | Joshi et al. | |
| 5,816,049 | A | 10/1998 | Joshi | |
| 5,865,024 | A | 2/1999 | Kress et al. | |
| 5,881,756 | A | 3/1999 | Abbasi et al. | |
| 5,899,075 | A | 5/1999 | Dean et al. | |
| 5,916,142 | A * | 6/1999 | Snyder et al. | 60/748 |
| 5,949,146 | A | 9/1999 | VandenBerghe | |
| 5,966,937 | A | 10/1999 | Graves | |
| 6,045,772 | A | 4/2000 | Szydlowski et al. | |
| 6,095,793 | A | 8/2000 | Greeb | |
| 6,113,078 | A | 9/2000 | Rock | |
| 6,141,967 | A | 11/2000 | Angel et al. | |
| 6,179,608 | B1 | 1/2001 | Kraemer et al. | |
| 6,301,899 | B1 | 10/2001 | Dean et al. | |
| 6,311,473 | B1 | 11/2001 | Benjamin et al. | |
| 6,311,496 | B1 | 11/2001 | Alkabie | |
| 6,339,923 | B1 | 1/2002 | Halila et al. | |
| 6,345,505 | B1 | 2/2002 | Green | |
| 6,655,145 | B1 * | 12/2003 | Boardman | 60/737 |
| 6,880,339 | B1 * | 4/2005 | Modi et al. | 60/737 |

OTHER PUBLICATIONS

Corr, R. et al. "Development of a Fuel and Air Mixer for an 11MW Gas Turbine Catalytic Combustion System," *Proceedings of the ASME Turbo Expo 2002*, (Jun. 3-6, 2002) Amsterdam, The Netherlands, pp. 609-617.

* cited by examiner

| Zone | Intended Airflow Angle (°) | Blade Count | Rhub (cm) | Rtip (cm) | Axial Chord (cm) | True Chord (cm) | Calculated Deviation (°) | Zweifel coeff. |
|---|---|---|---|---|---|---|---|---|
| | | | | | | | | |
| 5 (shroud) | 20 | 32 | 16.15 | 17.78 | 3.81 | 3.91 | 5.4 | 0.55 |
| 4 | 40 | 32 | 14.35 | 16.15 | 3.81 | 4.20 | 9.9 | 0.73 |
| 3 | 40 | 32 | 12.27 | 14.35 | 3.81 | 4.19 | 9.1 | 0.64 |
| 2 | 30 | 16 | 9.78 | 12.27 | 3.81 | 4.05 | 9.5 | 0.95 |
| 1 (hub) | 25 | 16 | 6.35 | 9.78 | 3.81 | 3.96 | 6.5 | 0.62 |

FIG. 14

FUEL-AIR PREMIXING SYSTEM FOR A CATALYTIC COMBUSTOR

CROSS-REFERENCE TO RELATED APPLICATIONS

The present application claims benefit of earlier filed provisional application U.S. Ser. No. 60/384,497, entitled "FUEL-AIR PREMIXING SYSTEM FOR A CATALYTIC COMBUSTOR," filed on May 31, 2002, which is incorporated herein in its entirety by reference.

BACKGROUND

1. Field of the Invention

This invention relates generally to a catalytic combustor for a gas turbine engine, and in particular, to a fuel-air mixer for a catalytic combustor for a gas turbine engine.

2. Description of Related Art

One widely used device for the generation of electricity, power, and heat is the gas turbine engine. A typical gas turbine engine operates by intaking air and pressurizing it using a rotating compressor. The pressurized air is passed through a chamber, or "combustor," wherein fuel is mixed with the air and burned. The high temperature combustion of the fuel-air mixture expands across a rotating turbine, resulting in a torque created by the turbine. The turbine may then be coupled to an external load to harness the mechanical energy. Gas turbine engines are commonly used for electrical generators, and to power turbo-prop aircraft, pumps, compressors, and other devices that may benefit from rotational shaft power.

In a typical gas turbine engine, the combustion chamber, fuel delivery system, and control system are designed to ensure that the correct proportions of fuel and air are injected and mixed within one or more "combustors." A combustor is typically a metal container, or compartment, where the fuel and air are mixed and burned. Within each combustor, there is typically a set of localized zones where the peak combustion temperatures are achieved. These peak temperatures commonly reach temperatures in the range of 3300 degrees Fahrenheit. These high temperatures also become the source of nitrogen oxide and nitrogen dioxide ($NO_x$) emissions, a known pollutant. Typically, to prevent thermal distress or damage to these metallic combustion chambers, a significant amount of the compressor air passes around the outside of the combustors to cool the combustors. The air, which then drives the turbine, is a combined mix of the hot combustion gasses and this cooling air. The resulting hot gas yield, which is admitted to the inlet of the turbine, is delivered at a temperature in the range of 2400° F. at full load for a typical industrial gas turbine. Unfortunately, virtually all of the $NO_x$ produced in the peak temperature zones within the combustor is exhausted into the atmosphere.

One method for reducing $NO_x$ formation in the combustion processes of a gas turbine engine includes premixing the fuel and air. As the fuel-to-air ratio changes within a combustor, the $NO_x$, formation within the combustor changes due to variations in the peak flame temperature and the availability of oxygen as the fuel-to-air ratio is altered. Premixing the fuel and air increases the uniformity of the fuel-air mixture and thereby provides temperature uniformity. The temperature uniformity minimizes the formation of high flame temperature zones and reduces the production of $NO_x$.

Numerous mixers and mixing devices are known for premixing fuel and air in conjunction with conventional combustors. One type of mixer, which is often referred to as an "open mixer," includes gas issuing from an orifice and being entrained with air within a long downstream region due to the kinetic energy of the high velocity flow path of the air and gas. Open mixers do not employ any internal obstructions and generally require the long downstream region for complete mixing. Another type of mixer includes internal baffles or swirlers, which divert flow paths to create shear and enhance turbulent mixing of the fuel and air without the long downstream region.

Drawbacks of conventional premixing designs, which employ internal baffles or swirlers, include flameholding, central vortex breakdowns, and recirculation in regions downstream of the baffles or swirlers. Flameholding generally refers to the premature auto-ignition of the fuel and air within the premixing region that is typically caused by insufficient flow velocity in the premixing region. Central vortex breakdowns and recirculation generally occurs in regions downstream from the baffles or swirlers, referred to as a diffuser region, and may be caused by too much or too little turbulence caused by the baffles or swirlers.

SUMMARY OF INVENTION

In accordance with one aspect of the invention, there is provided a premixing system for premixing fuel and air prior to combustion in a gas turbine engine that includes a catalyst. The premixing system includes a mixer housing having a mixer inlet region and a fuel inlet system interconnected with the mixer inlet region and located downstream of the mixer inlet region. The premixing system also includes a swirler interconnected with the fuel inlet system and located downstream of the fuel inlet system. The premixing system further includes a diffuser region interconnected with the swirler and located downstream of the swirler. A flow path is defined by the flow of air entering the mixer inlet region that passes through the fuel inlet system, the swirler, and the diffuser region. In one example, the mixer inlet region includes a contraction region that accelerates the flow prior to the swirler.

In accordance with another aspect of the invention, there is provided a premixing system for premixing fuel and air prior to combustion in a gas turbine engine that includes a catalyst. The premixing system comprises a mixer inlet region and a fuel inlet system interconnected with the mixer inlet region and located downstream of the mixer inlet region. The premixing system further includes a swirler interconnected with the fuel inlet system and located downstream of the fuel inlet system. The premixing system includes a diffuser region interconnected with the swirler and located downstream of the swirler. A flow path is defined by the flow of at least air from a compressor of the gas turbine engine. The flow enters the mixer inlet region and then passes through the fuel inlet system, swirler, and diffuser region prior to entering a catalyst of the gas turbine engine. The diffuser region decelerates the flow of air and the fuel prior to the catalyst.

In accordance with another aspect of the invention, there is provided a premixing system for premixing fuel and air prior to combustion in a gas turbine engine that includes a catalyst. The premixing system comprises a mixer inlet region and a fuel inlet system interconnected with the mixer inlet region and located downstream of the mixer inlet region. The premixing system includes a swirler interconnected with the fuel inlet system and located downstream of the fuel inlet system. The premixing system includes a diffuser region interconnected with the swirler and located downstream of the swirler. A flow path is defined by the flow of at least air from a compressor of the gas turbine engine such that the flow enters the mixer inlet region and then passes through the fuel inlet system, swirler, and diffuser region prior to entering a catalyst of the gas turbine engine. The diffuser region decelerates the flow of air and the fuel prior to the catalyst. The mixer inlet region includes a contraction region that accelerates the flow of air prior to the swirler.

In accordance with yet another aspect of the invention, there is provided a premixing system for premixing fuel and air prior to combustion in a gas turbine engine that includes a catalyst. The premixing system comprises a mixer inlet region and a fuel inlet system interconnected with the mixer inlet region and located downstream of the mixer inlet region. The fuel inlet system includes a fuel manifold and a plurality of fuel pegs that are fluidly connected to the fuel manifold. Each fuel peg has a first end, a second end, and a bore having a cross-sectional flow area. Each fuel peg further includes at least one fuel outlet port fluidly connected to the bore. Each fuel outlet port has a cross-sectional flow area. Each fuel peg further includes a leading edge and a trailing edge. The premixing system further includes a swirler interconnected with the fuel inlet system and located downstream of the fuel inlet system. The premixing system also includes a diffuser region interconnected with the swirler and located downstream of the swirler. A flow path is defined by the flow of at least air from a compressor of the gas turbine engine such that the flow enters the mixer inlet region and then passes through the fuel inlet system, swirler, and diffuser region prior to entering a catalyst of the gas turbine engine. Each fuel peg is positioned such that at least a portion of the fuel peg is located within the flow path and upstream of the swirler. Fuel is delivered from the fuel manifold to the bore of the fuel peg and injected into the flow path via the fuel outlet port in a direction substantially normal to the flow path of air.

In accordance with one aspect of the invention, there is provided a premixing system for premixing fuel and air prior to combustion in a gas turbine engine that includes a catalyst. The premixing system comprises a mixer inlet region and a fuel inlet system interconnected with the mixer inlet region and located downstream of the mixer inlet region. The premixing system also includes a swirler interconnected with the fuel inlet system and located downstream of the fuel inlet system. The premixing system further includes a diffuser region interconnected with the swirler and located downstream of the swirler. A flow path is defined by the flow of at least air from a compressor of the gas turbine engine such that the flow enters the mixer inlet region and then passes through the fuel inlet system, swirler, and diffuser region prior to entering a catalyst of the gas turbine engine. The premixing system has a central axis. The swirler includes at least three concentric planar rings. Any two adjacent concentric rings, called an inner ring and an outer ring, define a channel between the inner ring and the outer ring. The inner ring is located proximate to the central axis relative to outer ring. Each ring has an inner surface facing the central axis and an outer surface facing away from the central axis. The planar inner and outer surfaces are substantially parallel to the central axis. The swirler further includes a plurality of vanes securely disposed within each channel. Each vane has an inner end and an outer end. The inner end is proximate to the central axis relative to the outer end. Each vane includes a leading edge and a trailing edge. The leading edge is upstream of the flow path relative to the trailing edge, which is downstream of the leading edge. The leading edge is radially arranged with respect to the central axis. Each vane in a channel is curved in the same direction and vanes in adjacent channels are curved in a direction opposite to the vanes in the previous channel such that the swirler forms a counter-rotating design such that each channel turns the flow in a tangential direction opposite to its adjacent channel.

In accordance with another aspect of the invention, there is provided a premixing system for premixing fuel and air prior to combustion in a gas turbine engine that includes a catalyst. The premixing system comprises a mixer inlet region and a fuel inlet system interconnected with the mixer inlet region and located downstream of the mixer inlet region. The premixing system also includes a swirler interconnected with the fuel inlet system and located downstream of the fuel inlet system. The premixing system also includes a diffuser region interconnected with the swirler and located downstream of the swirler and upstream of the catalyst. A flow path is defined by the flow of at least air from a compressor of the gas turbine engine such that the flow enters the mixer inlet region and then passes through the fuel inlet system, swirler, and diffuser region prior to entering a catalyst of the gas turbine engine. The premixing system has a central axis. The swirler includes at least three concentric planar rings. Any two adjacent concentric rings, called an inner ring and an outer ring, define a channel between the inner ring and the outer ring. The inner ring is located proximate to the catalyst relative to outer ring. Each ring has an inner surface facing the catalyst and an outer surface facing away from the catalyst. The planar inner and outer surfaces of the rings are substantially perpendicular to the central axis. The swirler further includes a plurality of vanes securely disposed within each channel. Each vane has an inner end and an outer end. The inner end is proximate to the catalyst relative to the outer end. Each vane includes a leading edge and a trailing edge. The leading edge is upstream of the flow path relative to the trailing edge, which is downstream of the leading edge. The leading edge is substantially parallel to the central axis. Each vane in a channel is curved in the same direction and vanes in adjacent channels are curved in a direction opposite to the vanes in the previous channel such that the swirler forms a counter-rotating design such that each channel turns the flow in a tangential direction opposite to its adjacent channel.

In accordance with another aspect of the invention, there is provided a premixing system for premixing fuel and air prior to combustion in a gas turbine engine that includes a catalyst. The premixing system comprises a mixer inlet region and a fuel inlet system interconnected with the mixer inlet region and located downstream of the mixer inlet region. The fuel inlet system includes a fuel manifold and a plurality of fuel pegs that are fluidly connected to the fuel manifold. Each fuel peg has a first end, a second end, and a bore having a cross-sectional flow area. Each fuel peg further includes at least one fuel outlet port fluidly connected to the bore. Each fuel outlet port has a cross-sectional flow area. Each fuel peg further includes a leading edge and a trailing edge. The premixing system further includes a swirler interconnected with the fuel inlet system and located downstream of the fuel inlet system. The premixing system also includes a diffuser region interconnected with the swirler and located downstream of the swirler. The premixing system includes a center body disposed within the premixing system. A flow path is defined by the flow of at least air from a compressor of the gas turbine engine such that the flow enters the mixer inlet region and then passes through the fuel inlet system, swirler, and diffuser region prior to entering a catalyst of the gas turbine engine. The premixing system has a central axis and the center body is located along the central axis of the premixing system. Each fuel peg is positioned such that at least a portion of the fuel peg is located within the flow path and upstream of the swirler. Fuel is delivered from the fuel manifold to the bore of the fuel peg and injected into the flow path via the fuel outlet port. The diffuser region decelerates the flow prior to the catalyst. The mixer inlet region includes a contraction region that accelerates the flow prior to the swirler. The swirler includes at least three concentric planar rings. Any two adjacent concentric rings, called an inner ring and an outer ring, define a channel between the inner ring and the outer ring. The swirler further includes a plurality of vanes securely disposed within each channel. Each vane has an inner end and an outer end. Each vane includes a leading edge and a trailing edge. The leading edge is upstream of the flow path relative to the trailing edge, which is downstream of the leading edge. Each vane in a channel is curved in the same direction and vanes in adjacent channels are curved in a direction opposite to the vanes in the previous channel such that the swirler forms a counter-rotating design such that each channel turns the flow in a tangential direction opposite to its adjacent channel.

In accordance with another aspect of the invention, there is provided a method for premixing fuel and air prior to combustion in a gas turbine engine that includes a catalyst. The method includes the acts of accelerating a flow of air, adding fuel to the accelerated flow of air, and creating a swirling motion to the accelerated flow of air and fuel to promote mixing of the accelerated flow of air and the fuel. In one example, the method further includes decelerating the mixture of the air and the subsequent to creating the swirling motion.

BRIEF DESCRIPTION OF THE DRAWINGS

The foregoing and other advantages of the invention will become apparent upon reading the following detailed description and upon reference to the drawings in which:

FIG. 14 is a table of design parameters according to one variation of a swirler for an axial flow premixing system.

Figure 1:
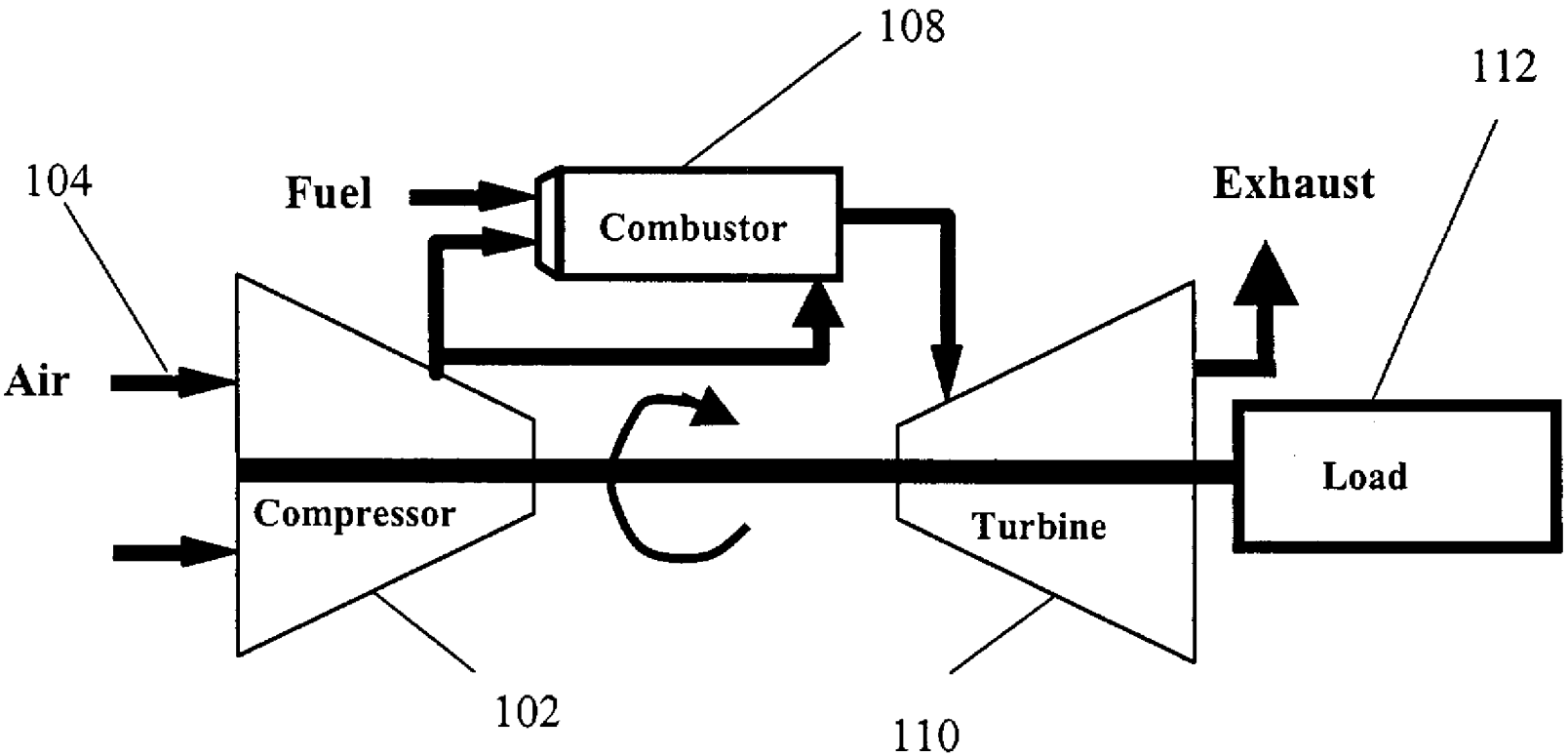
Fig 1 (PRIOR ART)
FIG. 1 is a schematic diagram of gas turbine engine.

While the invention is susceptible to various modifications and alternative forms, specific variations have been shown by way of example in the drawings and will be described herein. However, it should be understood that the invention is not limited to the particular forms disclosed. Rather, the invention is to cover all modifications, equivalents, and alternatives falling within the spirit and scope of the invention as defined by the appended claims.

DETAILED DESCRIPTION

The present invention provides fuel-air premixers for catalytic combustors. The following description is presented to enable any person skilled in the art to make and use the invention. Descriptions of specific applications are provided only as examples. Various modifications to the preferred embodiments will be readily apparent to those skilled in the art, and the general principles defined herein may be applied to other embodiments and applications without departing from the spirit and scope of the invention. Thus, the present invention is not intended to be limited to the examples shown, but is to be accorded the widest scope consistent with the principles and features disclosed herein.

According to one aspect of the invention a premixer is described that includes a fuel inlet system and a swirler located within a mixer housing. The fuel inlet system is located upstream of the swirler. The swirler includes an assembly of one or more baffles that impart a swirling motion to the flow of air and fuel to promote mixing. In one example, the swirler imparts counter-rotating swirling motions to the flow of air and fuel. Further, in one example, a contraction zone is included in a mixer inlet region that accelerates the flow of air prior to the swirler. In another example, a diffuser region is included that decelerates the flow of air downstream of the swirler. According to another aspect of the invention, the fuel is introduced to the flow of air at near normal angles to the direction of the flow path of the air. Further, the fuel is introduced though aerodynamically shaped fuel pegs to reduce recirculation zones and minimize flameholding.

Premixer designs for a catalytic combustor generally include stringent specifications for fuel-to-air uniformity and thermal uniformity, as well as typical requirements for desired life and pressure loss in any combustor system. Also, the premixer is desirably made resistant to flameholding by minimizing recirculation zones and maintaining high bulk air velocity in zones where fuel is injected. It is desired that minimum requirements of an exemplary pre-mixing system include a fuel-air uniformity of approximately ±5% or better, a thermal uniformity of approximately ±10° C., and a pressure loss of less than approximately 0.5% of the inlet total pressure. Further improvement beyond these requirements is desirable because it may potentially improve catalyst life and the load range over which low carbon monoxide emissions are achieved.

FIG. 1 schematically shows an example of a typical existing gas turbine employing a catalytic combustion system. In this system, a compressor 102 ingests ambient air 104 through a compressor bellmouth or the like, and compresses air 104 to a high pressure and then drives the compressed air, at least in part, through the combustor 108 and through the drive turbine 110. The combustor 108 combines the fuel and air and combusts this mixture to form a hot, high velocity gas stream that flows through the turbine 110, which provides the power to drive the compressor 102 and the load 112 such as a generator.

Figure 2:
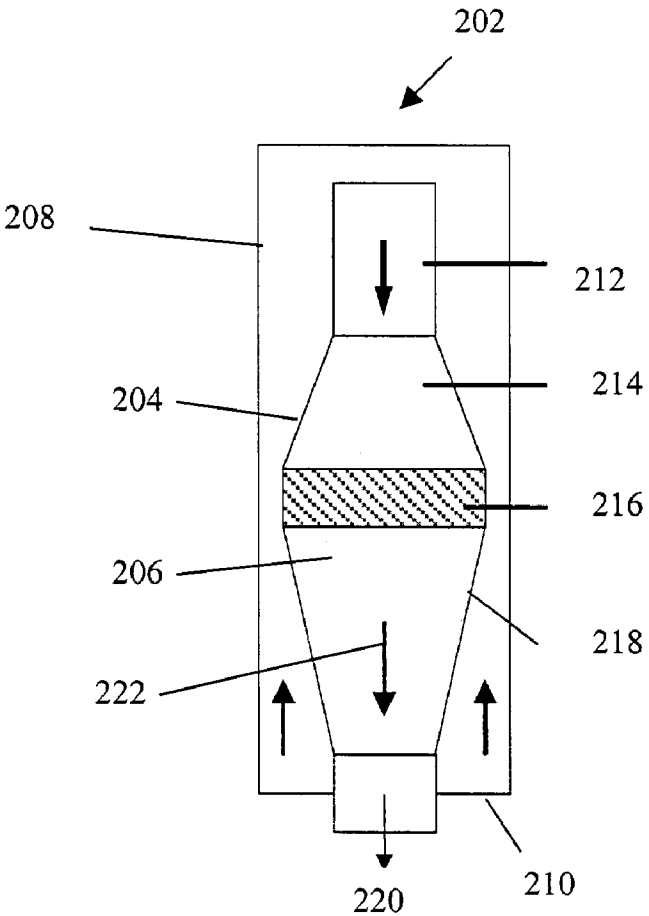
FIG. 2 is a schematic diagram of a combustor having an axial premixing configuration.

FIG. 2 is a detailed view of a combustor 108 of FIG. 1 having an axial combustor configuration and having an exemplary premixing system according to one aspect of the invention. Specifically, as shown in FIG. 2, a catalytic combustor 202 is provided. Combustor 202 includes a liner assembly 204 defining a combustion chamber 206. The liner assembly 204 is disposed and secured within a pressure casing 208. The combustor 202 includes six elements that are arrayed serially in the flow path. Specifically, these six interconnected elements include a combustor inlet 210, a prebumer 212, a premixing system 214, a catalyst 216, a burnout zone 218, and a combustor outlet 220. In the axial flow configuration, the premixing system 214 is aligned with an upstream prebumer 212 and a downstream catalyst 216 with all three components located on the same centerline 222. Together, the components occupy a volume, which is relatively small in diameter but long in length. The combustor 202 may also by configured to have a radial or annual configuration.

Figure 3:
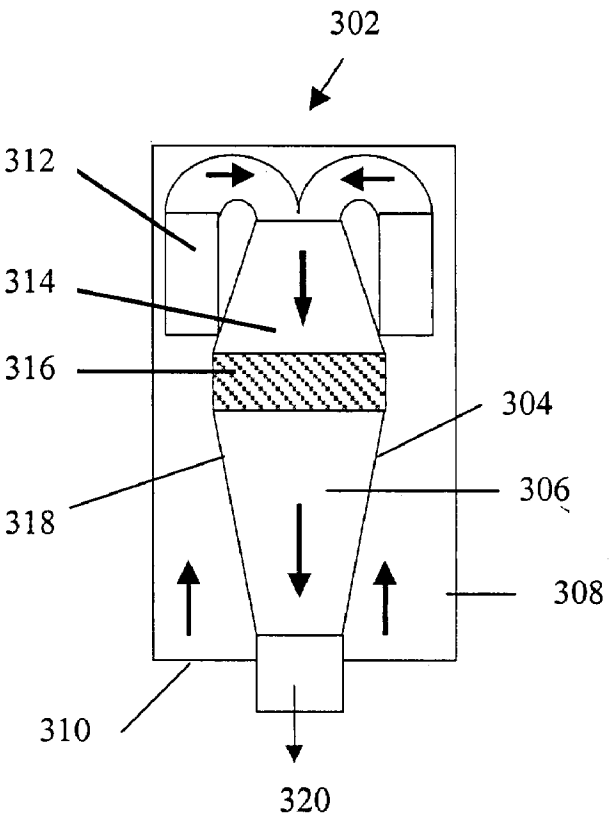
FIG. 3 is a schematic diagram of a combustor having a radial premixing configuration.

FIG. 3 is a close up view of a combustor 108 of FIG. 1 having a radial configuration and having a premixing system according to one aspect of the invention. Specifically, as shown in FIG. 3, a catalytic combustor 302 is provided. The catalytic combustor 302 includes a liner assembly 304 defining a combustion chamber 306. The liner assembly 304 is disposed and secured within a pressure casing 308. The catalytic combustor 302 includes six elements that are arrayed serially and concentrically in the flow path. Specifically, these six interconnected elements include a combustor inlet 310, a preburner 312, a premixing system 314, a catalyst 316, a burnout zone 318, and a combustor outlet 320. In the radial inflow approach, the preburner discharge flow turns radially inward approximately 90 degrees, flows into the premixing system 314 and then makes another approximately 90-degree turn prior to entering the catalyst 316. In this example, the total bulk flow re-direction for the radial inflow concept is approximately 180 degrees, i.e., two 90-degree turns, whereas there is no bulk air flow turning with the axial configuration.

A radial inflow premixing design can be incorporated with either the axial or annular preburner configuration. In an axial preburner configuration, the preburner discharge air would enter the premixer's outer annular region and turn approximately 90 degrees to flow radially inward. The air would flow through the premixer and turn approximately 90 degrees as it exits the premixer and enters the diffusion section. In this example, the bulk flow turns 90 degrees twice but results in a net zero change in direction.

With reference to FIGS. 1–3 further operation of exemplary combustors 202, 302 are described. The exiting hot gases from the combustor 108 in FIG. 1 flows into the drive turbine 110, which produces power to drive a load 112. In preferred aspects, there are two or more independently controlled fuel streams, with one or more streams directed to a preburner 212, 312 and the other stream directed to the premixing system 214, 314 of combustors 202, 302. The combustors 202, 302 generally operate in the following manner. The majority or all of the air from the gas turbine compressor 102 flows through the preburner 212, 312 and catalyst 216, 316. The preburner 212, 312 functions to help start up the gas turbine 110 and to adjust the temperature of the air and fuel mixture to the catalyst 216, 316 to a level that will support catalytic combustion of the main fuel stream, which is injected and mixed with the prebumer discharge gases prior to entering catalyst 216, 316. In various aspects, the catalyst 216, 316 may consist of either a single stage or a multiple stage catalyst, i.e., two or more catalysts in series. Partial combustion of the fuel and air mixture occurs in the catalyst 216, 316, with the balance of the combustion then occurring in the burnout zone 218, 318. Typically, approximately 10% to approximately 90% of the fuel is combusted in the catalyst 216, 316.

Reaction of any remaining fuel not combusted in the catalyst 216, 316 and the reaction of any remaining carbon monoxide to carbon dioxide occurs in the burnout zone 218, 318, thereby advantageously obtaining higher temperatures without subjecting the catalyst 216, 316 to these temperatures and obtaining very low levels of unburned hydrocarbons and carbon monoxide. After combustion has completed in the burnout zone 218, 318, any cooling air or remaining compressor discharge air is then introduced into the hot gas stream, typically just upstream of the turbine inlet. In addition, if desired, air can optionally be introduced through the liner wall 204, 304 at a location close to the turbine inlet as a means to adjust the temperature profile to that required by the turbine 110.

Figure 4:
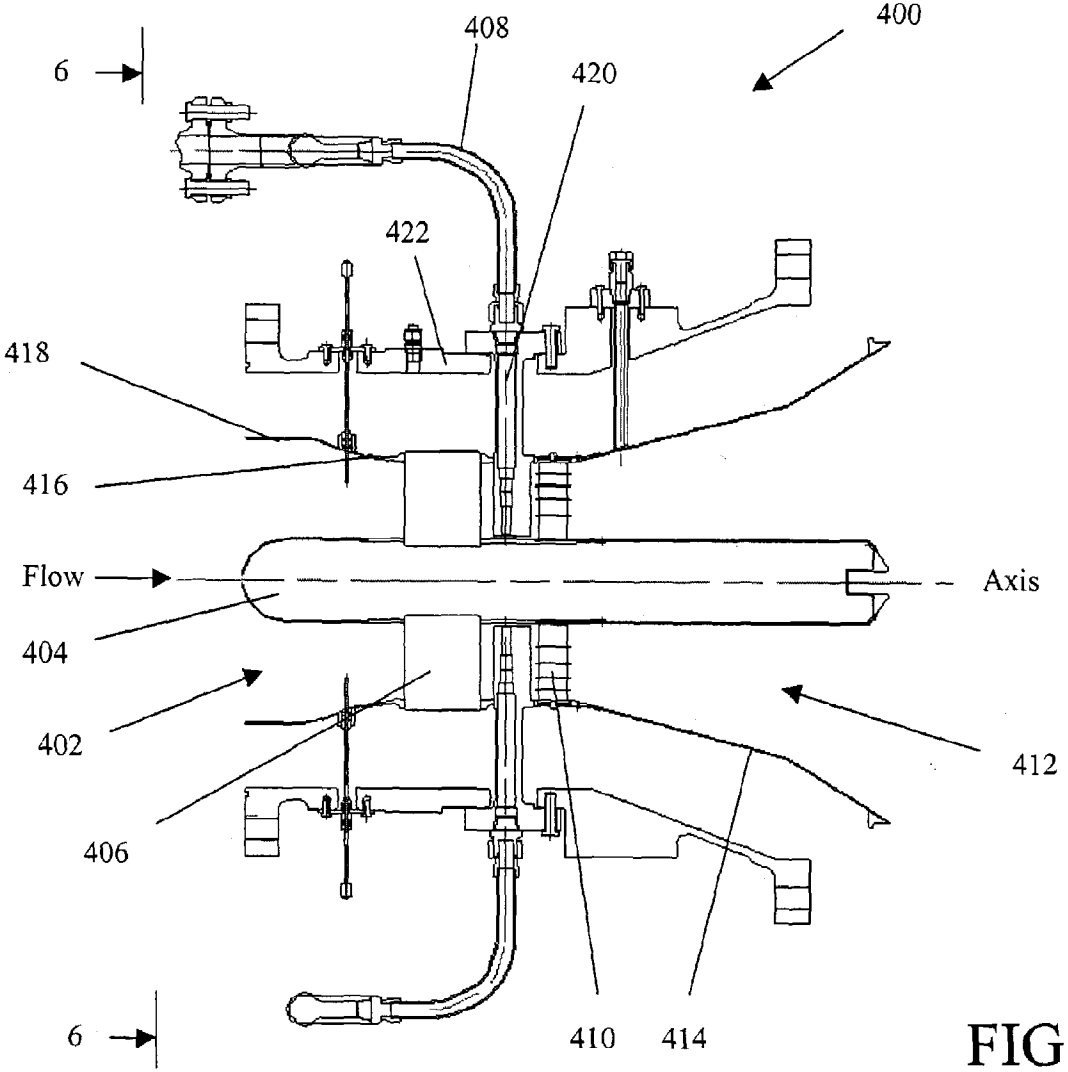
FIG. 4 is a side elevation cross-sectional view of an axial flow premixing system.

FIG. 4 illustrates an exemplary premixing system or mixer system. In particular, FIG. 4 illustrates a side cross-sectional view of an axial flow premixing system 400 that may be included with the catalytic combustor of FIG. 2. This premixing system 400 includes a mixer inlet region 402, a center body 404, at least one center body support structure 406, a fuel inlet system 408, a swirler 410, and a diffuser region 412. The mixer inlet region 402 is upstream of the fuel inlet system. 408 and the swirler 410, which is upstream of the diffuser region 412. The center body 404 may be held to the liner assembly 414 with an airfoil-shaped center body support structure 406 and is located along a central axis of the premixing system and extends along substantially the full length of the premixing system. The center body 404 helps to reduce or eliminate flow breakdown and recirculation in the diffuser region 412.

Figure 5:
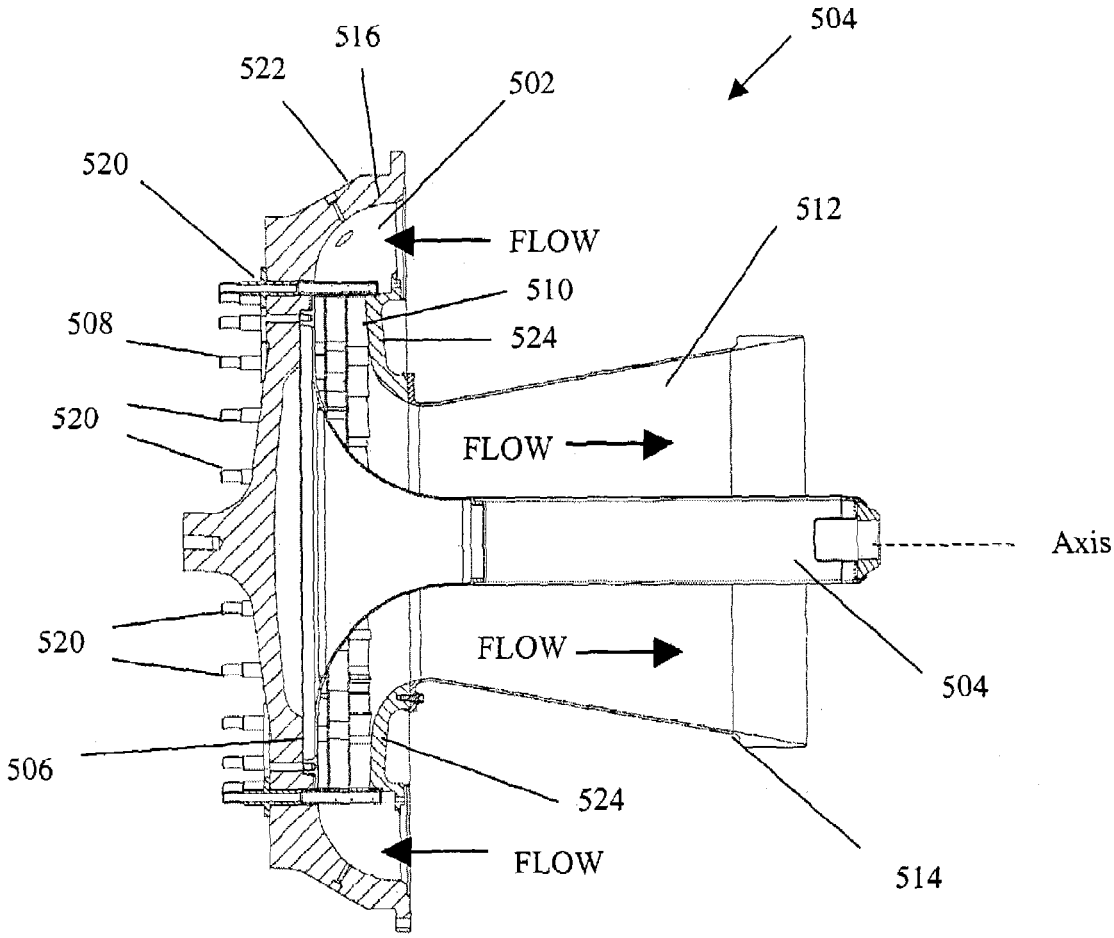
FIG. 5 is a side elevation cross-sectional view of a radial flow premixing system.

FIG. 5 illustrates another exemplary premixing system or mixer system 500. In particular, FIG. 5 illustrates a side cross-sectional view of a radial flow premixing system 500 that may be included with the catalytic combustor of FIG. 3. The premixing system 500 includes an annular mixer inlet region 502, a center body 504, at least one center body support structure 506, a fuel inlet system 508, a swirler 510, and a diffuser region 512. The annular mixer inlet region 502 is upstream of the fuel inlet system 508 and the swirler 510, which is upstream of the diffuser region 512. The center body 504 is secured to the pressure casing 522 with the center body support structure 506. The liner assembly 514 is secured to the pressure casing 522 via an annular flange element 524 and fasteners (not shown). The center body 504 helps to eliminate flow breakdown and recirculation in the diffuser region 512.

With reference to FIGS. 4 and 5, the operation of both exemplary premixing systems 400, 500 is described in greater detail. The mixer inlet region 402, 502 of both the axial premixing system 400 and the radial premixing system 500 includes a cross-sectional area that decreases to form a contraction region 416, 516. The contraction region 416, 516 has a cross-sectional area that decreases with distance along the flow path. The cross-sectional area of the contraction region 416, 516 is smaller than the cross-sectional area of the pre-contraction region 418 (not shown in FIG. 5) upstream of the contraction region 416, 516. For example, the area of the contraction region 416 of the axial premixing system of FIG. 4 may be approximately 10–20% less than the area of the pre-contraction region 418. For the annular mixer inlet region of the radial flow premixing system of FIG. 5, the area of the contraction region 516 may be included in the annular area that is approximately 10% less than the pre-contraction region (not shown), which is also annular in the radial system configuration. In one variation, the contraction region 416 of an axial premixing system 400 reduces the cross-sectional flow path diameter from approximately 42 cm to approximately 36 cm in a conical section of approximately 11 cm in length. The contraction region accelerates the flow of air. The flow acceleration is preferably accomplished by a smooth and uniform tapering without the introduction of features such as steps or gaps that would lead to flow separation. Various shapes can be employed such as a straight-walled contraction region, curved or trumpet shaped contraction region. This contraction serves to increase the bulk velocity and helps homogenize the flow field. Both of these characteristics increase the premixing system's resistance to flameholding by ensuring adequate velocity of the flow and preventing premature auto-ignition.

Referring to FIG. 4, the fuel inlet system 408 includes a plurality of fuel pegs 420. In one example, the liner assembly 414 may be supported by fuel pegs 420, which are bolted to the pressure casing 422. Liner assembly 414 may be made at least in part from Hastelloy-X®, for example. In this example, the fuel peg 420 to liner 414 interface is a slip-fit. The fuel pegs 420 are positioned radially and extend from the liner 414 inwardly to contact the center body such that a portion of the fuel peg is positioned in the flow path.

It should be recognized that the premixing system described with respect to FIGS. 4 and 5 are illustrative only and that numerous variations may be made to the premixing systems depending on the particular application and configuration of the combustor. For example, in some examples the contraction region and/or diffusion region may be omitted or altered. Further, various device included in the examples may be simplified or omitted depending on the particular application.

Figure 6:
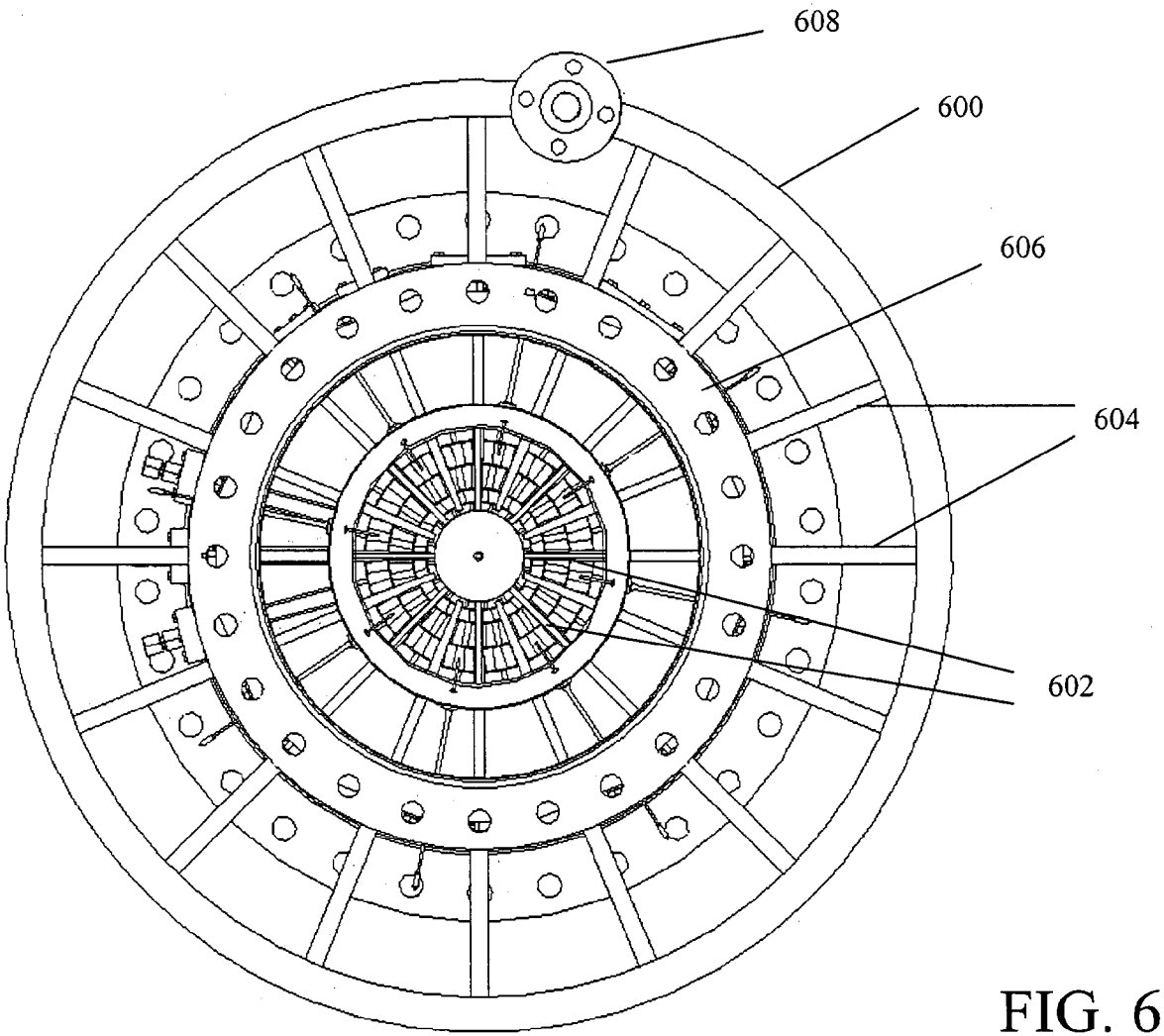
FIG. 6 is a cross-sectional end view of the axial premixing system along line 6—6 of FIG. 4.

FIG. 6 illustrates a cross-sectional end view along line 6—6 of FIG. 4. The fuel inlet system 408 includes a ring fuel manifold 600 in fluid communication with a plurality of fuel pegs 602 via flexible metal tubes 604. The ring fuel manifold 600 is secured to the pressure casing 422, 606 with fasteners and has a single feed 608. The fuel pegs are positioned such that at least a portion of each fuel peg is located within the flow path denoted by the arrow in FIG. 4. Each fuel peg is located downstream of the contraction region 416 and upstream of the swirler 410. Fuel is delivered from the fuel manifold 600 to the fuel pegs 420, 602 and injected into the flow path.

With respect to the radial premixing system 500, a plurality of fuel pegs 520 are located downstream of the contraction region 516 and upstream of the swirler 510 as shown in FIG. 5. The fuel pegs 520 are also fluidly connected to a fuel manifold (not shown). The fuel pegs 520 are secured to the pressure casing 522 with fasteners. The fuel pegs 520 are positioned such that at least a portion of each fuel peg 520 is located within the flow path denoted by the arrows in FIG. 5. Fuel is delivered from the fuel manifold (not shown) to the fuel pegs 520 and injected into the flow path.

Figure 7:
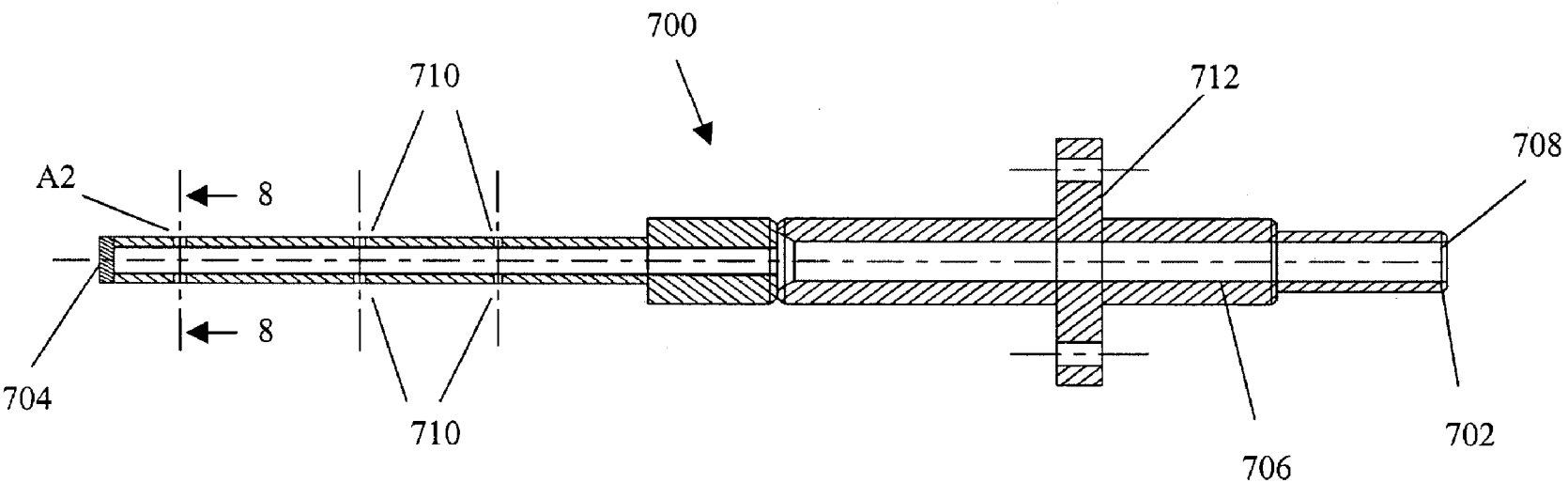
FIG. 7 is a side elevation cross-sectional view of a fuel peg.

Referring now to FIG. 7, an exemplary fuel peg 700 that may be used with a premixing system is illustrated. Fuel peg 700 includes an elongated member having a first end 702 and a second end 704. The fuel peg 700 includes a bore 706 extending from the first end 702 towards the second end 704. The first end 702 includes a fuel inlet port 708 and the second end 704 includes a plurality of fuel outlet ports 710 in fluid communication with the bore 706. As mentioned above, the fuel peg 700 is positioned radially and extends inwardly such that the fuel outlet ports 710 at the second end 704 of each fuel peg 700 are positioned in the flow path of incoming prebumer gases. In one variation, each fuel outlet port 710 has a diameter of at least approximately 0.50 mm. As shown in FIG. 7, the fuel peg 700 includes six fuel outlet ports 710 in fluid communication with the bore 706. In one variation, each fuel peg 700 includes 20 fuel outlet ports 710. However, the invention is not so limited and any number of fuel outlet ports 710 is within the scope of the invention. The fuel outlet ports 710 are located along the fuel peg 700 to inject fuel in a direction normal to the flow path of incoming preburner gases. In one variation, pairs of fuel ports 710 are positioned across the bore 706 as shown in FIG. 7. The fuel pegs 700 are machined or cast and provide structural support for the center body assembly in the axial premixing system. The fuel peg 700 illustrated in FIG. 7 is substantially identical for both the axial and radial premixing systems. However, the number of fuel outlet ports 710 and their positioning as well as the cross-section taken along line 8—8 at the second end 704 will vary according to system demands for optimum performance.

Figure 8:
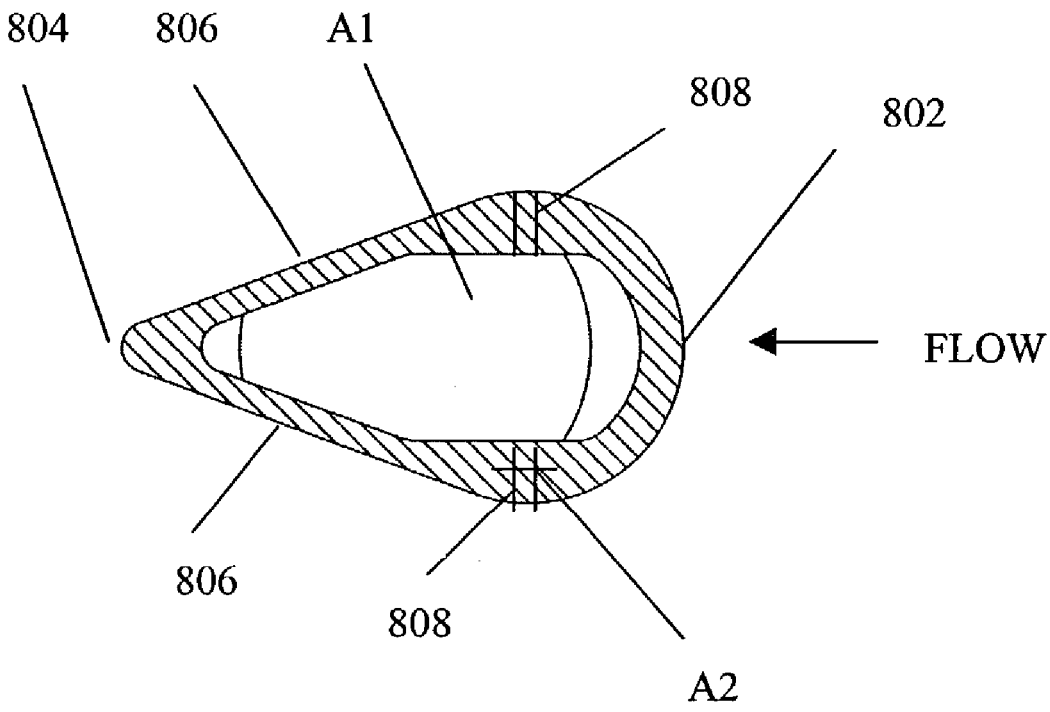
FIG. 8 is a cross-sectional view along line 8—8 illustrating another variation of the fuel peg of FIG. 7.

The second end 704 or that portion of the fuel peg 700 which is positioned in the "hot" flow upstream of the swirler, may have a cross-section that is aerodynamically shaped in both the axial and radial premixing systems. Referring now to FIG. 8, a cross-section taken along line 8—8 of the fuel peg of FIG. 7 is illustrated. The fuel peg 700 includes a leading edge 802 and a trailing edge 804. Fuel outlet ports 808 are shown in FIG. 8. The fuel peg 700 is aerodynamically shaped such that the trailing edge 804 includes tapered fairings 806. As can be seen in FIG. 8, the fuel peg 700 is gently tapered radially from the leading edge 802 towards the trailing edge 804. The aerodynamically shaped fuel pegs produce a uniform blockage distribution to the approaching gas flow. The tapered fairings 806 help to eliminate recirculation zones from forming in the wake regions of the fuel peg, which can function as sources of undesirable flameholding. The cross-section depicted in FIG. 8 can be employed for both the axial and radial premixing systems; however, the invention is not so limited.

Figure 9:
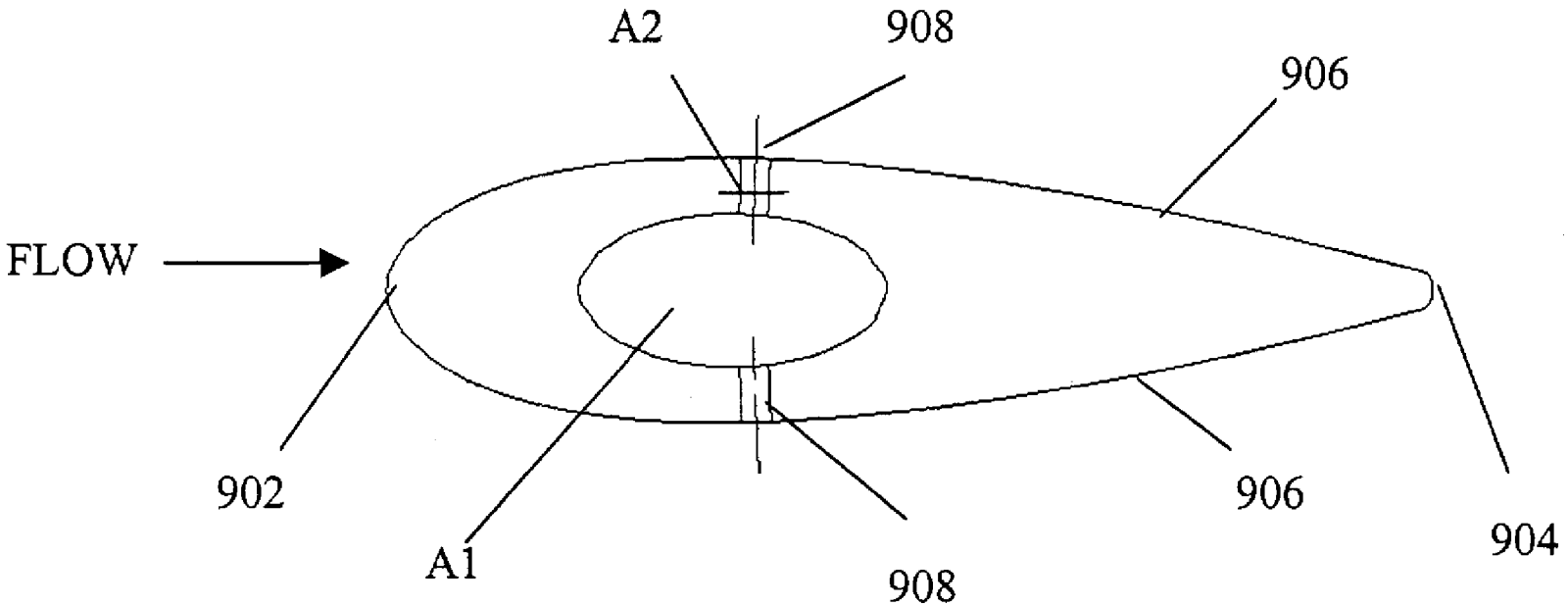
FIG. 9 is a cross-sectional view along line 8—8 illustrating another variation of the fuel peg of FIG. 7.

FIG. 9 is a cross-sectional view along line 8—8 illustrating another variation of the fuel peg 700 of FIG. 7. The fuel peg 700 includes a leading edge 902 and a trailing edge 904. Fuel outlet ports 908 are also shown. The fuel peg 700 is aerodynamically shaped such that the trailing edge 904 includes tapered fairings 906. In one variation, the fuel peg 700 has an NACA 0030 airfoil cross-section. As can be seen in FIG. 9, the fuel peg 700 is gently tapered radially from the leading edge 902 towards the trailing edge 904. The tapered fairings 906 help to eliminate recirculation zones from forming in the wake regions of the fuel peg, which may function as sources of undesirable flameholding. The cross-section depicted in FIG. 9 can be employed for both the axial and radial premixing systems; however, the invention is not so limited.

At the second end 704 of the fuel peg 700, the bore 706 has a cross-sectional flow area A1 as shown in FIGS. 8 and 9 and each fuel outlet port 710, 808, 908 defines a cross-sectional outlet port area A2 as shown in FIGS. 8 and 9. The bore cross-sectional flow area A1 is preferably at least approximately 2.5 to approximately 3.5 times the combined total fuel outlet port areas A2 for the entire fuel peg 700 which is expressed as follows:

$$\frac{A1}{\sum_{i=1}^{n} A2_i} \geq 2.5 \approx 3.5$$

where n is the number of fuel outlet ports

This relation ensures that the cross flow effects and variations in the static pressure of the gas within the fuel peg feeding each of the individual fuel outlet ports are minimized such that proper jetting is achieved. Minimization of the variations of the gas pressure within the fuel pegs is useful in ensuring high gas jet penetration angles into the flow path of the bulk airflow. The gas may be injected into the flow path of the bulk airflow through the fuel outlet port 710 in a direction normal to the bulk airflow and the bulk airflow turns the gas jet. With a sufficient fuel port pressure ratio, the jet penetration angle will be high, approximately near 90 degrees. With lower pressure ratios or poorly distributed pressure within the fuel peg cavity, the penetration angle will be near zero after the fuel contacts the bulk airflow. Consistent and predictable fuel injection characteristics result in improved mixing between the fuel and incoming air.

Figure 10:
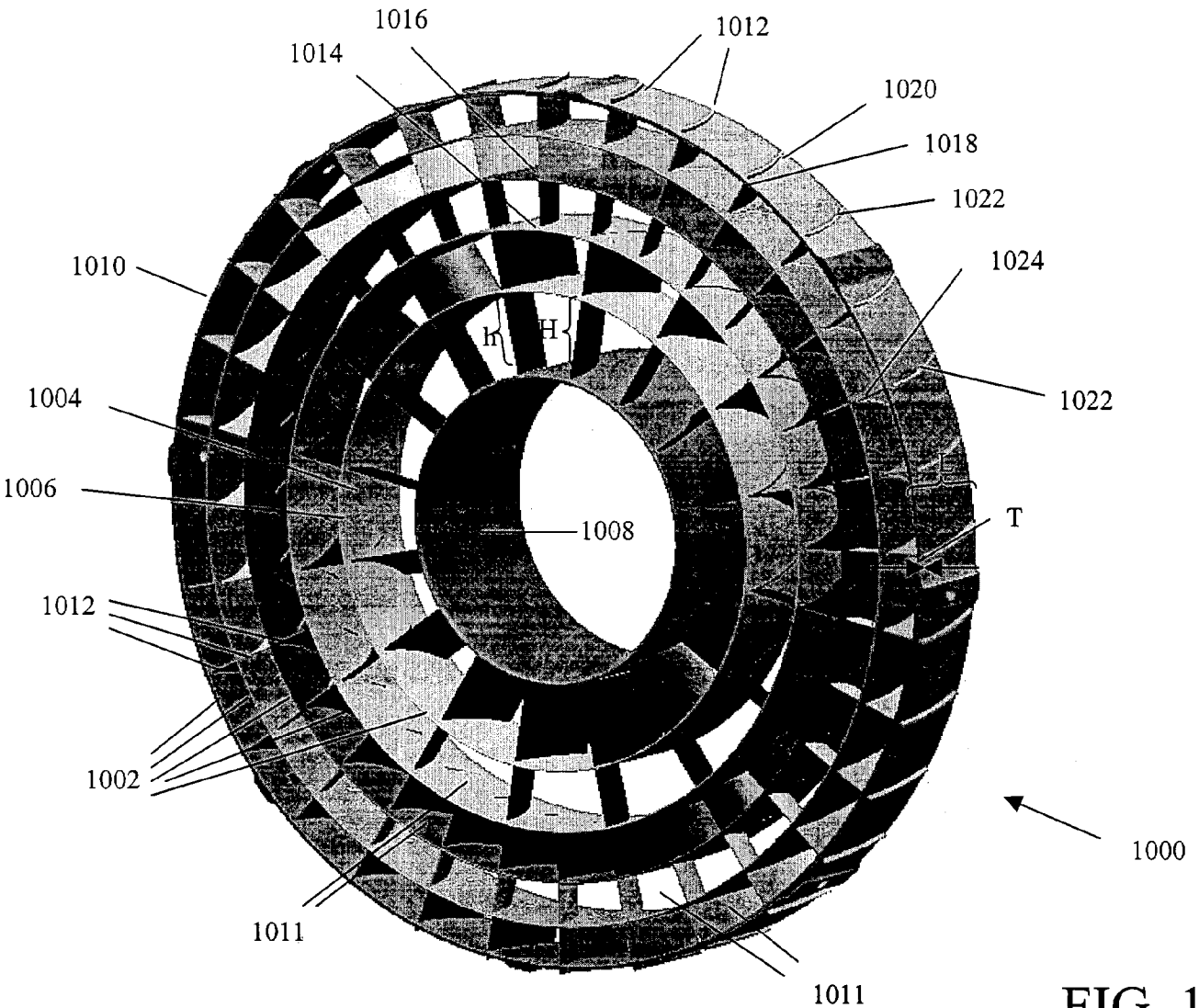
FIG. 10 is a perspective view of a swirler for an axial premixing system.

Referring now to FIG. 10, a swirler or swirler vane-pack 1000 is illustrated that may be used, for example, in conjunction with an axial combustor configuration having a center body as illustrated in FIGS. 2 and 4. Swirler 1000 is particularly adapted for an axial combustor because the bulk airflow is not turned when passing through swirler 1000, as is desired with the radial combustor configuration. With particular reference to FIG. 4, the swirler 410, 1000 is positioned downstream of the fuel pegs 420 and upstream of the diffusion region 412. The swirler 410, 1000 is retained between the liner assembly 414 and the center body 404 by ledges in each of those parts. Pins (not shown) fasten the swirler 410, 1000 to the liner 414 and prevent it from rotating.

Still referencing FIG. 10, the swirler 1000 includes a series of concentric rings 1002 spaced apart by a distance H from one another, where distance H may vary with adjacent rings 1002. The rings 1002 are made of sheet metal and have a length L of approximately 2 inches to approximately 3 inches and a thickness T of approximately 0.050 inches to approximately 0.100 inches. The aspect ratio of the channel is defined as the ratio of distance H to length L or H/L. Each ring 1002 has an inner surface 1004 facing the center body or hub and an outer surface 1006 facing the liner or shroud. The rings 1002 are arranged such that the planar surfaces of the rings 1002 are parallel to the axial direction and substantially parallel to the bulk flow path. The innermost ring 1008 is the hub ring 1008 and the outermost ring 1010 is the shroud ring 1010. Any two adjacent concentric rings (called an inner ring and an outer ring) define a channel or stack 1011 therebetween. The inner ring is proximate the hub relative to the outer ring which is proximate to the shroud of any two adjacent concentric rings.

The swirler 1000 further includes a plurality of vanes 1012 radially arranged between adjacent rings within the channel 1011. Each vane 1012 is made of sheet metal and has a height h, an inner end 1014, an outer end 1016, a leading edge 1018, and a trailing edge 1020. The inner end 1014 is proximate the inner ring of any two adjacent concentric rings relative to the outer end 1016 which is proximate to the outer ring of any two adjacent concentric rings. The leading edge 1018 is upstream of the flow path relative to the trailing edge 1020, which is downstream of the leading edge 1018. The leading edge 1018 is radially arranged with respect to the axis.

In one variation, the outer ring of any two adjacent concentric rings includes a plurality of slots 1022. Each slot 1022 formed in the outer ring is adapted to receive the outer end 1016 of a vane 1012. The vane 1012 is positioned within a slot 1022 and welded therein. In one variation, the inner ring of any two adjacent concentric rings of the channel 1011 also includes a plurality of slots 1024. Each slot 1024 formed in the inner ring is adapted to receive the inner end 1014 of the vane 1012. The height h of the vane 1012 is greater than the distance H between the inner and outer rings such that the vane 1012 is retained between the inner and outer rings, however, there is room for the vane 1012 to thermally expand within the channel 1011. In another variation, the inner end 1014 of the vane 1012 is welded to the inner ring such that the outer end 1016 of the vane 1012 is free to thermally expand within the channel 1011 whether or not slots 1022 are formed in the outer ring. In yet another variation, neither end of the vane 1012 is welded such that the vane 1012 is free to float and thermally expand within slots formed in both the inner and outer rings without falling out. The swirler assembly is held in place axially by ledges or steps in the inner center body 404 and outer shroud 414.

Figure 11:
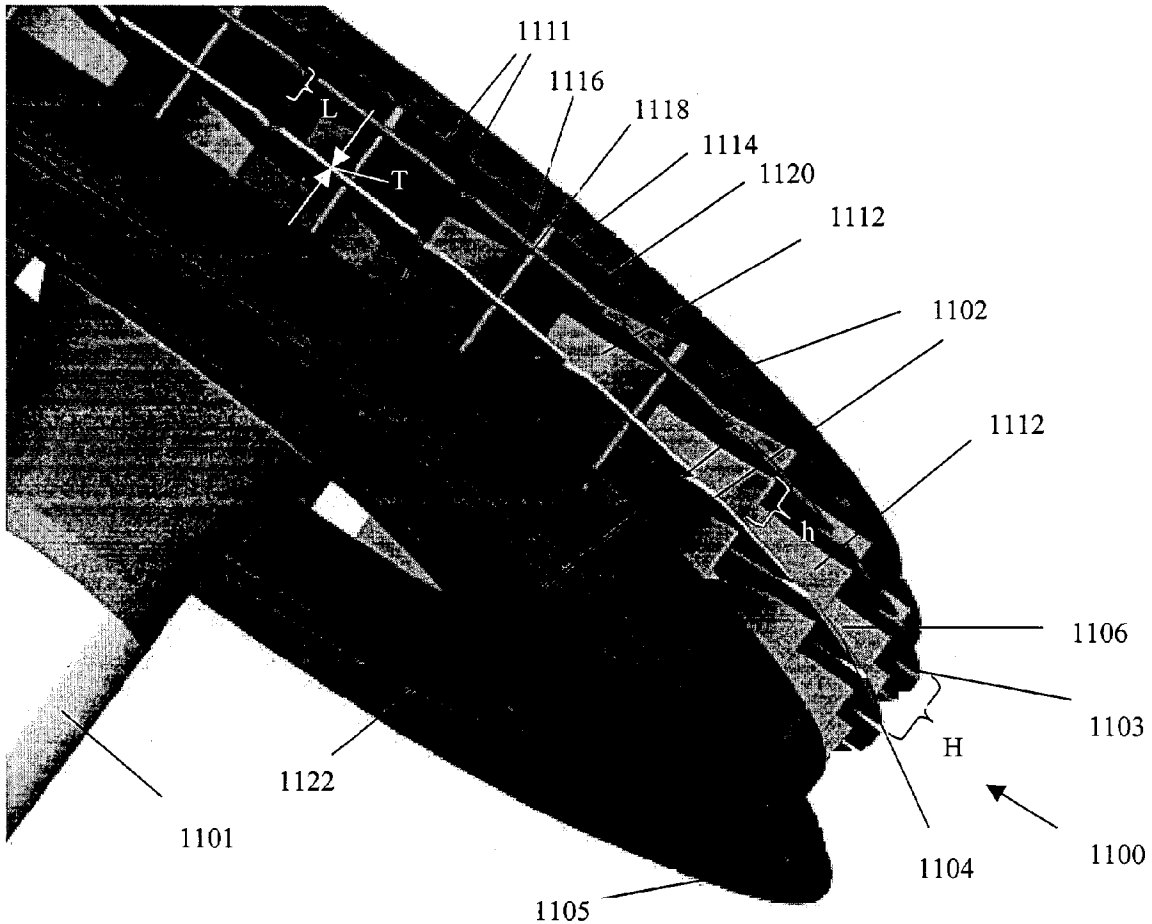
FIG. 11 is a perspective view of a swirler for a radial premixing system.

With regard to FIG. 11, a multi-channel counter-rotating swirler 1100 is illustrated that may be used, for example, in conjunction with the radial combustor configuration of FIGS. 3 and 5. A swirler or swirler vane-pack 1100 adapted for a radial combustor configuration having a center body 1101 is shown in FIG. 11. The swirler 1100 is particularly adapted for a radial combustor because swirler 1100 may accept the bulk airflow in a radial direction, such that the bulk airflow may be turned before and/or after passing through swirler 1100. With particular reference to FIG. 5, the swirler 510, 1100 is positioned downstream of the fuel pegs 520 and upstream of the diffuser region 512. The swirler 510, 1100 is retained between the annular flange element 524, 1105 and the pressure casing 522 by ledges in each of those parts. The swirler 1100 includes a perimeter 1103. The fuel pegs 520 are uniformly arranged about the perimeter 1103 of the swirler 1100.

Still referencing FIG. 11, the swirler 1100 includes a series of concentric rings 1102 spaced apart by a distance H from one another. The rings 1102 are made of sheet metal and have an inner and outer diameter difference corresponding to a radial length L of approximately 2 inches to approximately 3 inches and a thickness T of approximately 0.050 inches to approximately 0.125 inches. The aspect ratio is defined for the channel as before as the ratio of distance H to length L or H/L. Each ring 1102 has an inner surface 1104 facing the catalyst and an outer surface 1106 facing away from the catalyst. The rings 1102 are arranged such that the planar surfaces of the rings 1102 are perpendicular to the axial direction and substantially parallel to the bulk flow path. The bulk flow of the prebumer discharge gases enters the swirler 1100 in a direction substantially perpendicular to the axial direction. The bulk flow is directed in the radial direction when it leaves the swirler 1100. Any two adjacent concentric rings (called an inner ring and an outer ring) define a channel or stack 1111 therebetween. The inner ring of any two adjacent concentric rings is proximate the catalyst relative to the outer ring.

The swirler 1100 further includes a plurality of vanes 1112 axially arranged between adjacent rings within the channel 1111. Each vane 1112 is made of sheet metal and has a height h, an inner end 1114, an outer end 1116, a leading edge 1118, and a trailing edge 1120. The inner end 1114 is proximate the inner ring of any two adjacent concentric rings relative to the outer end 1116 which is proximate to the outer ring of any two adjacent concentric rings. The leading edge 1118 is upstream of the flow path relative to the trailing edge 1120, which is downstream of the leading edge 1118. The leading edge 1118 is axially arranged such that leading edge 1118 is substantially parallel to the axis.

In one variation, the outer ring of any two adjacent concentric rings includes a plurality of slots 1122. Each slot 1122 formed in the outer ring is adapted to receive the outer end 1116 of a vane 1112. The vane 1112 is positioned within a slot 1122 and welded therein. In one variation, the inner ring of any two adjacent concentric rings of the channel 1111 also includes a plurality of slots 1124 (not shown). Each slot 1124 formed in the inner ring is adapted to receive the inner end 1114 of the vane 1112. The height h of the vane 1112 is greater than the distance H between the inner and outer rings such that the vane 1112 is retained between the inner and outer rings, however, there is room for the vane 1112 to thermally expand with in the channel 1111. In another variation, the inner end 1114 of the vane 1112 is welded to the inner ring such that the outer end 1116 of the vane 1112 is free to thermally expand within the channel 1111 whether or not slots 1122 are formed in the outer ring. In yet another variation, neither end of the vane 1112 is welded such that the vane 1112 is free to float and thermally expand within slots formed in both the inner and outer rings without falling out.

Figure 12A:
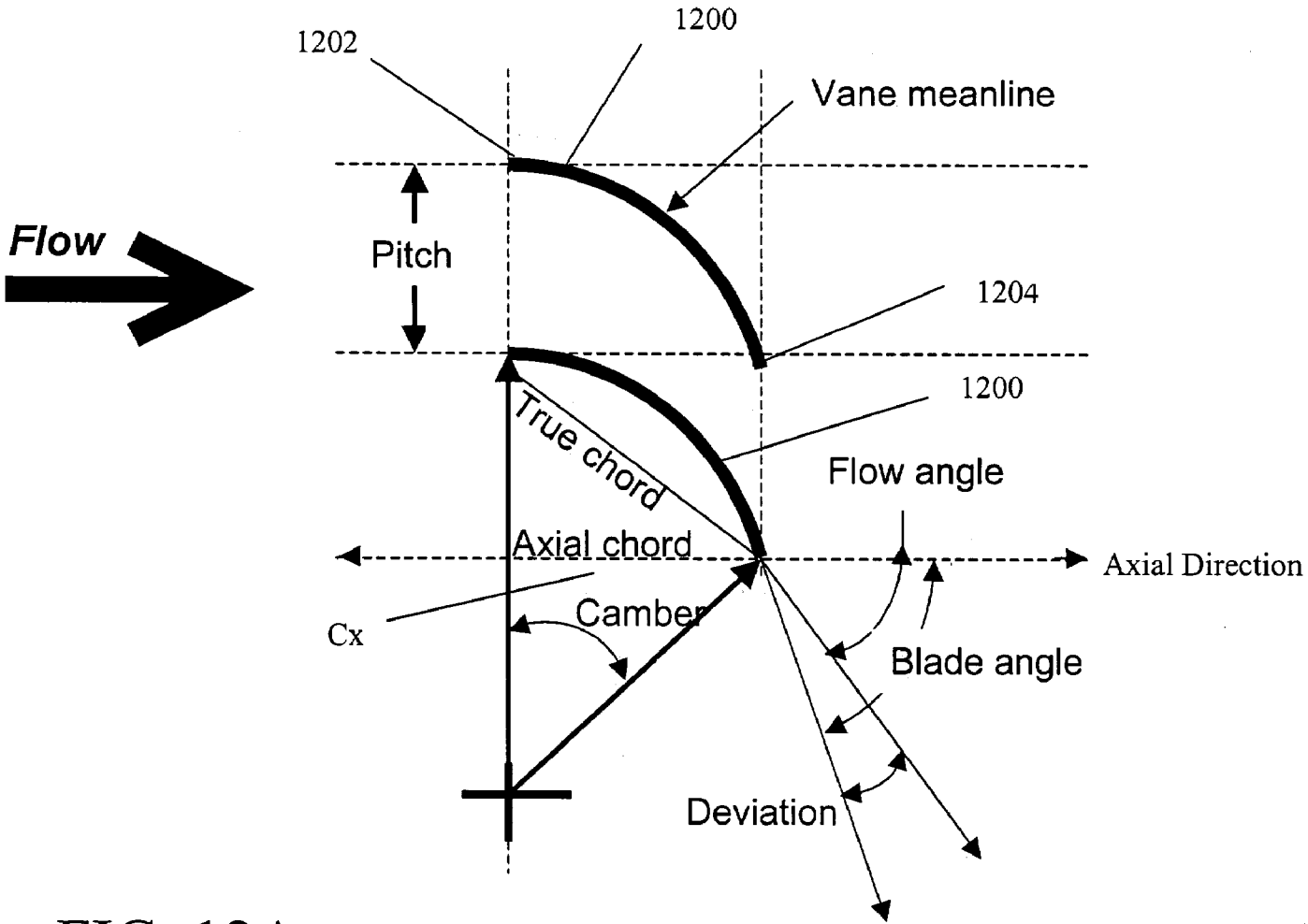
FIG. 12A is a schematic of two vanes of a channel in an axial or radial premixing system.

In one example, the vanes of both the axial and radial swirlers are curved from their leading edge first contacted by the bulk airflow to their trailing edge from which the airflow departs. Each vane in a channel is curved in the same direction and vanes in adjacent channels are curved in a direction opposite to the vanes in the previous channel such that the swirler forms a counter-rotating design. The vane channels are "counter-rotating" in nature with each channel turning the flow in a tangential direction opposite to its adjacent channel. Referring now to FIG. 12A, a schematic of two vanes of a channel in an axial or radial premixing system is shown with the flow path depicted by the arrow. As can be seen in FIG. 12A, each vane 1200 is curved along a circular arc meanline between the leading edge 1202 and the trailing edge 1204. The true chord is defined as the straightline distance between the leading edge and trailing edge of the vane 1200 as shown in FIG. 12A. The blade angle is defined as the "metal" angle that the individual vane. 1200 forms in the circumferential direction relative to the axis of the swirler. The flow angle is the aerodynamic angle that the airflow forms in the circumferential direction relative to the axis of the swirler. The deviation angle is the difference between the metal angle and the aerodynamic angle. The camber angle is the total angle through which the flow is turned from the inlet to the outlet of the vane 1200. The axial chord $C_x$ is the distance between the leading edge 1202 and the trailing edge 1204 that lies in the axial direction. The distance between vanes 1200 is defined as the pitch S.

For both axial and radial swirlers, the swirl flow angles may be selected and adjusted to distribute the flow in some manner between channels for a given diffuser region shape and design. Also, maintaining a deviation angle of less than 10 degrees was found to minimize or at least reduce the risk of flow separation within the swirler. The angles were selected and adjusted until full diffusion took place without central vortex breakdown in the diffuser region as a result of too much swirl. Central vortex breakdown generally refers to a condition wherein airflow in a region either stops or reverses direction and flows from the catalyst face toward the swirler. Also, angles were selected to prevent recirculation at the outer wall of the diffuser region as a result of too little swirl.

The solidity of a channel is defined as the ratio of the axial chord length $C_x$ to the circumferential vane spacing or pitch S ($C_x$/S). In one example, for both the axial and radial configurations described above, the solidity is selected to maintain a Zweifel loading coefficient or diffusion factor Df of each channel less than unity, Df<1. The diffusion factor is defined as follows:

$$Df = 1 - \left(\frac{V2}{V1}\right) + \left(\frac{\Delta Cw}{2 \times V1}\right) \times \left(\frac{S}{Cx}\right)$$

where:

V2=the absolute velocity at vane outlet (suction surface; wherein the suction surface is the convex surface of the vane)

V1=the absolute velocity at vane inlet (suction surface)

ΔCw=the change in tangential velocity across the vane

S/Cx=1/solidity.

If the solidity of the swirler is excessively low, flow separation within the swirler is possible and can be problematic. Flow separation within the swirler is undesirable from a flameholding perspective and maintaining a solidity sufficiently high such that the Zweifel loading coefficient remains below a value of one is found to ensure good swirler aerodynamic performance.

Figure 12B:
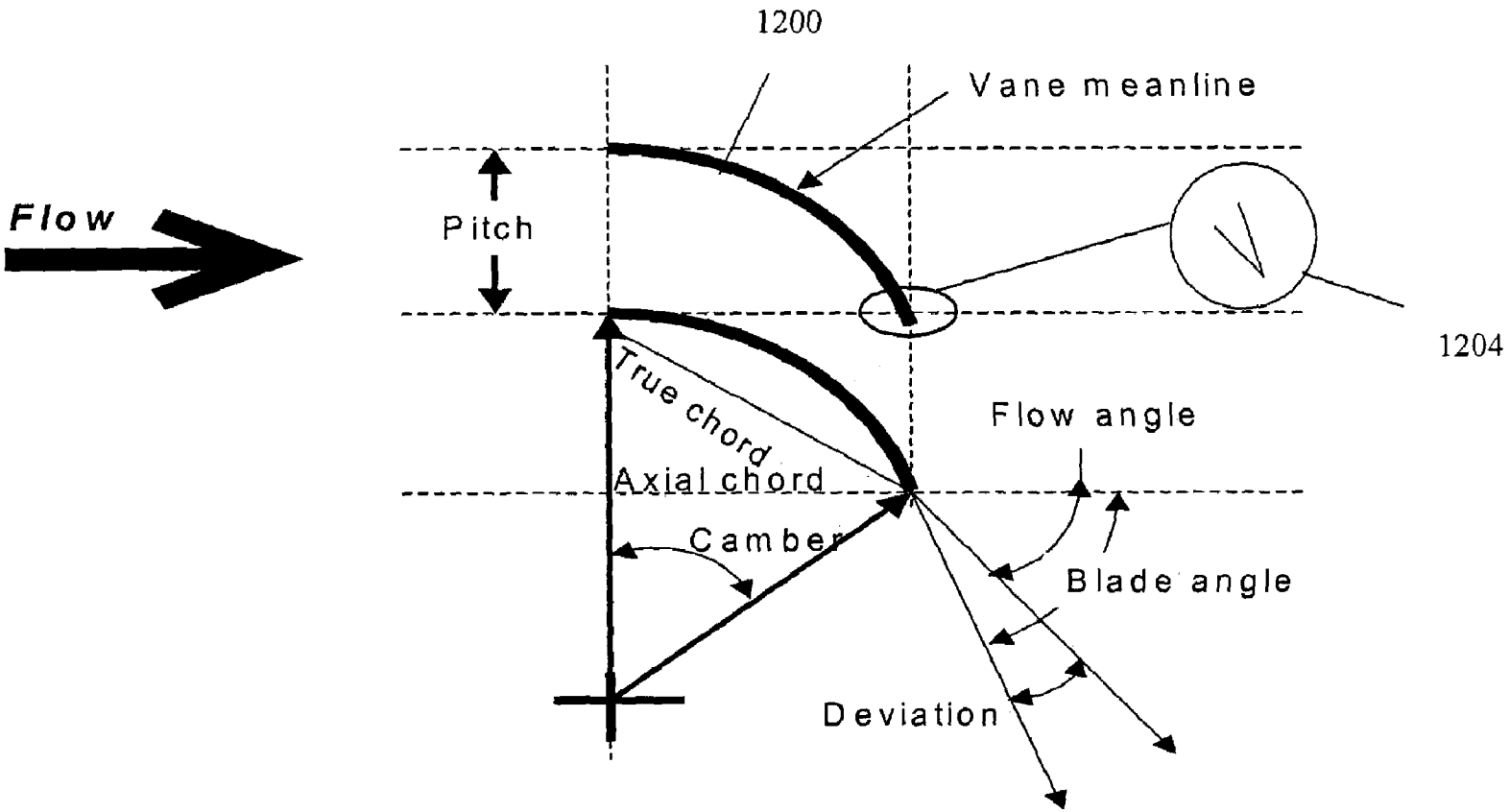
FIG. 12B is a detailed view of a trailing edge of an exemplary vane.

In one variation, the trailing edge 1204 of the vanes 1200 may be tapered to reduce the recirculation at the trailing edge 1204 of each vane 1200 as illustrated in FIG. 12B. If a larger recirculation zone is formed, the propensity for that zone to function as a flameholding region increases. Tapering the trailing edge region of the individual vanes effectively reduces the likelihood of flameholding recirculation zones. Taper angles on the vane trailing edges 1204 are preferably approximately 30 to 45 degrees, however, other angles and shapes are possible depending on the particular application.

For both the axial and radial systems, the number of swirler vane channels or stacks is based on many factors including the design of the diffuser region, which will be discussed below. Another factor that influences the number of channels in the swirler is the ratio of the catalyst inlet flow area to the swirler exit flow area. There is a relationship between this ratio and the number of channels in the swirler. Generally, if this ratio increases, then the number of vane channels also increases. For an axial flow system, three or more than three channels are typically employed. For example, for a ratio of catalyst inlet flow area to the swirler exit flow area of approximately 4:1, five channels are preferably employed. Factors that influence the number of vane channels include the aerodynamic features of the flow entering the swirler, the performance requirements of the overall system and the area ratio between the swirler outlet and the catalyst inlet. A minimum of three channels are preferably employed for a radial inflow system featuring a large catalyst inlet flow area relative to the swirler exit flow area. The number of vane channels is related to achieving a sufficient radial turbulence spread in the diffusing section to prevent vortex breakdown. Undesirable flow separation with associated auto-ignition and flameholding in the diffusing section is possible with vortex breakdown.

For both the axial and radial systems, in order to ensure that the fuel is uniformly and evenly distributed, the number of vanes in each channel is preferably selected to be an integer multiple of the number of individual fuel pegs as expressed by the equation below:

$$V=Np$$

In the above equation, V is the number of vanes in a channel, p is the number of fuel pegs, and N is any integer, N=1, 2, 3, and so on.

The multi-channel, counter-rotating aspect of the swirler design provides for high fluid shear rates desirable for turbulent mixing in the diffuser region. The optimization of the counter-rotating vane angle distribution provides for stable, non-recirculating flow in the diffusing section of the mixer. The fuel and air mixing is achieved by the spread of turbulence resulting from the high fluid shear rates established by the swirler. Mixing also occurs as a result of initial dispersion of the fuel jets and the secondary flow structure established within the swirler channels that creates secondary flow paths or vectors in directions other than the direction of the bulk flow. Diffusion of the mixture takes place between the swirler outlet and downstream catalyst in the diffuser region.

Figure 13:
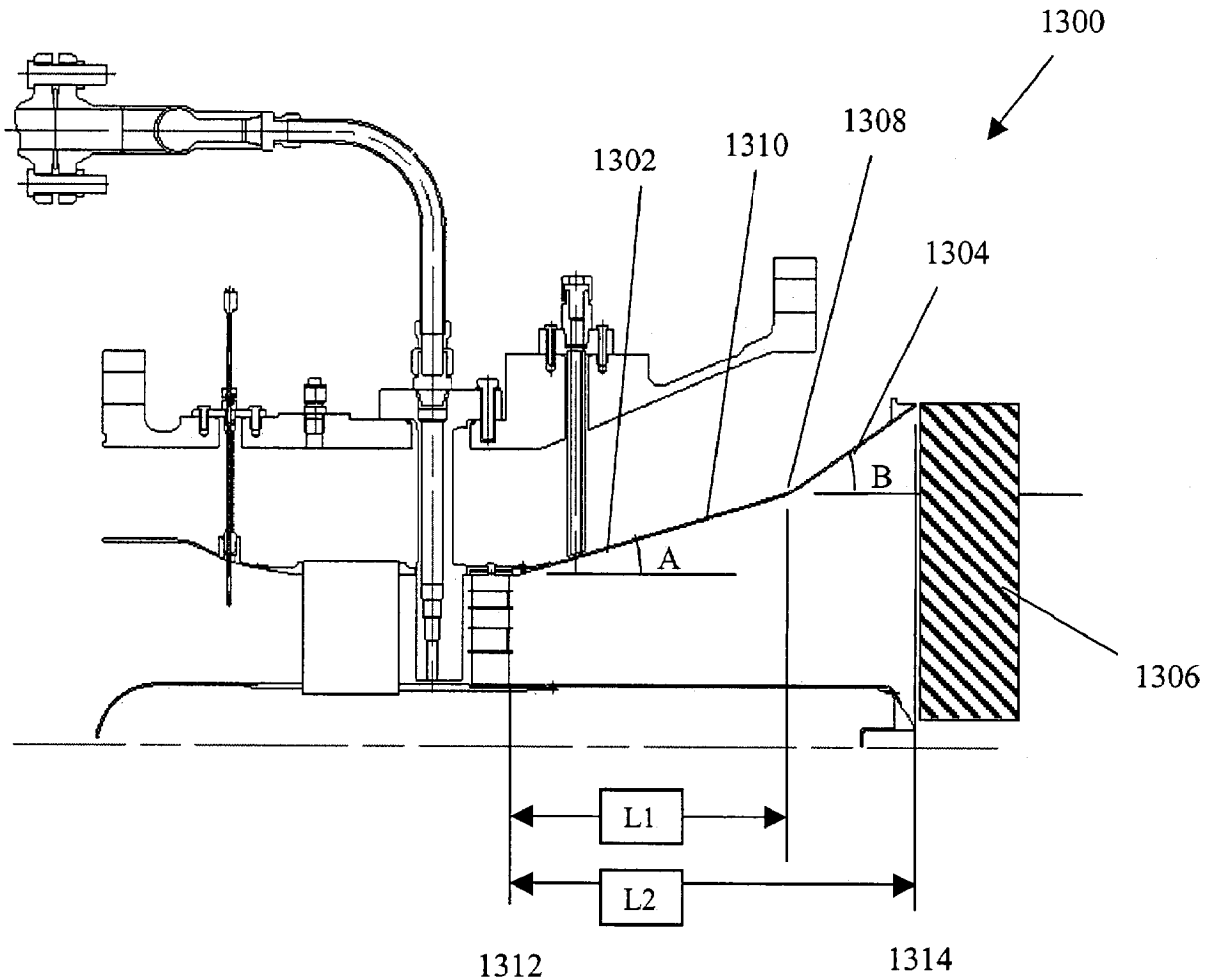
FIG. 13 is a side elevation partial cross-sectional view of an axial flow premixing system having a dual-angled diffuser region.

With reference to FIGS. 4 and 5, the diffuser region will now be discussed in greater detail. For both the axial and radial systems, the shape of the liner wall in the diffuser region 412, 512 is such that the cross-sectional area along the diffuser region expands with distance downstream of the flow path and decelerates the flow prior to the air-fuel mixture reaching the catalyst. Various shapes can be employed such as straight walled diffusers as shown in FIG. 5, curved or trumpet shaped diffusers and dual-angle, straight walled diffusers as shown in FIG. 4. Although the diffuser region 512 of the radial premixing system is shown in FIG. 5 to be straight walled and the diffuser region 412 of the axial premixing system shown in FIG. 4 is dual-angled, the invention is not so limited and variations of diffuser wall shapes are possible for both the radial and axial systems. In one variation, a dual angle straight walled diffuser as depicted in FIG. 13 is employed. Although the dual-angled diffuser is shown for an axial system, the same dual-angled diffuser is applicable to the radial construction. The dual angle straight walled diffuser region 1300 includes a shallow-angle first section 1302 and a high-angle second section 1304. The wall 1310 of the first section 1302 forms an angle with respect to the central axis that is smaller relative to the second section 1304. The wall 1310 of the second section 1304 forms an angle with respect to the central axis that is greater relative to the first section 1302. The shallow-angle first section 1302 keeps the velocity high for achieving high rates of shear in the diffuser region 1300 where the fuel and air have not yet completely mixed in order to reduce the flameholding potential in this area. The high-angle second section 1304 takes advantage of the catalyst's 1306 resistance to flow and resultant back pressure effect to quickly diffuse the flow and reduce the velocity down to an optimum velocity for catalyst operation without inducing significant recirculation zones. Although straight walls are employed, the invention is not so limited and curved dual-angled walls may be employed. Straight walls, however, may be less costly to manufacture than curved walls.

If a dual angle diffuser region is employed in either of the axial or radial systems, the location of the inflection point 1308 in the liner wall 1310 of the diffuser region 1300 may be desirably located to decrease the flame holding risk. The inflection point 1308 is located between the first, section 1302 and the second section 1304. In one variation, the inflection point 1308 in the liner wall 1310 of the diffuser region 1300 is located approximately 50% to approximately 75% from the swirler throat or swirler exit area 1312 to the catalyst face 1314 as shown FIG. 13. The distance from the swirler exit area 1312 to the inflection point 1308 is defined as L1. The distance from the swirler exit area 1312 to the catalyst inlet area 1314 is defined as L2. Therefore, the ratio of L1/L2 is preferably defined as follows:

$$0.5 \le \left(\frac{L1}{L2}\right) \le 0.75$$

Locating the inflection point between the first section 1302 and the second section 1304 approximately ⅔ the distance from the swirler outlet area 1312 to the catalyst inlet area 1314 reduces the flame holding risk by maintaining higher velocities in the fuel rich regions immediately downstream of the swirler outlet 1312. Also, undesirable flow separation in the higher angled second section 1304 is less likely due to the back pressuring influence of the catalyst 1306.

Minimizing overall fuel-air mixer length, including the diffuser region length, is desirable for a variety of reasons including weight and packaging. One means of reducing the overall length is to reduce the length of the diffuser region. A means of reducing diffuser length for a fixed catalyst and swirler exit diameter while preserving acceptable aerodynamics is to incorporate a compound liner wall having dual angles. Maximum wall angles, while preserving acceptable aerodynamics, are generally dictated by the swirler characteristic and quality of the incoming flow field. In one example, acceptable aerodynamics were found in an exemplary pre-mixing system where the angle A that the liner wall 1310 of the first section 1302 makes with the axis of the diffuser region 1300 is approximately 10 to 18 degrees, and the angle B that the liner wall 1310 of the second section 1304 makes with the axis of the diffuser region 1300 is approximately 30 to 45 degrees.

A table of design parameters for a swirler for an axial combustor and a diffuser region having a dual-angled wall described above is shown in FIG. 14. Five channels are employed numbered one through five with the first channel being located proximate the hub and the fifth channel being located proximate the shroud. The counter-rotating flow angles are 25/30/40/40/20 for channels one to five, respectively. For the first channel, the distance from the center to the inner ring is indicated by the value Rhub to be 6.35 cm. The distance from the center to the outer ring of the first channel is indicated by the value Rtip to be 9.78 cm. Therefore, the distance H is 3.43 cm (9.78 cm−6.35 cm=3.43 cm) and the aspect ratio is approximately 0.90 (3.43 cm/3.81 cm). Similarly, for the second channel the distance from the center to the inner ring is indicated by the value Rhub to be 9.78 cm. The distance from the center to the outer ring of the second channel is indicated by the value Rtip to be 12.27 cm. Therefore, the distance H is 2.49 cm and the aspect ratio is approximately 0.65 (2.49 cm/3.81 cm). For the third channel the distance from the center to the inner ring is indicated by the value Rhub to be 12.27 cm. The distance from the center to the outer ring of the third channel is indicated by the value Rtip to be 14.35 cm. Therefore, the distance H is 2.08 cm and the aspect ratio is approximately 0.55 (2.08 cm/3.81 cm). For the fourth channel the distance from the center to the inner ring is indicated by the value Rhub to be 14.35 cm. The distance from the center to the outer ring of the fourth channel is indicated by the value Rtip to be 16.15 cm. Therefore, the distance H is 1.8 cm and the aspect ratio is approximately 0.47 (1.8 cm/3.81 cm). For the fifth channel the distance from the center to the inner ring is indicated by the value Rhub to be 16.15 cm. The distance from the center to the outer ring of the fifth channel is indicated by the value Rtip to be 17.78 cm. Therefore, the distance H is 1.63 cm and the aspect ratio is approximately 0.43 (1.63 cm/3.81 cm). As can be seen, in this variation, the aspect ratio generally decreases with each consecutive channel in a direction from hub to shroud. However, the invention is not limited such that the aspect ratio for each consecutive channel decreases. For example, adjacent channels may have the same aspect ratio so long as there is a general trend for the aspect ratio to decrease with distance from hub to shroud. As can be seen in FIG. 13, the deviation is less than 10 degrees for each channel and the Zweifel coefficient is less than one for each channel.

For both the axial and radial systems, the number of fuel outlet ports per peg is preferably based upon the number of the swirler channels. Generally, there is a minimum of one pair of fuel outlet ports aligned with each vane channel per peg across the entire flow path, and oriented to inject fuel in a direction normal to the flow path as illustrated in FIGS. 7–9. The pair of fuel outlet ports is located substantially in the middle of the channel at a distance of approximately H/2 from either the inner or outer ring of any adjacent pair of concentric rings. At least one pair of fuel outlet ports is located per channel. However, the locations and sizes of the fuel peg outlet ports are preferably based on the required fuel-air uniformity at the face of the catalyst. Using the example of a five-stack swirler having parameters tabled in FIG. 14, for the first channel where H is 3.43 cm, there are two pairs of fuel outlet ports on the fuel peg and they are located evenly across the channel, at approximately H/3. For example, the first pair of fuel outlet ports is located a distance of approximately H/3 from the inner ring, the second pair of fuel outlet ports is located a distance of approximately H/3 from the first pair of fuel outlet ports and from the outer ring. The next two pairs of fuel outlet ports are also centrally located on the second channel and so on for subsequent channels. Although a pair of adjacent outlet ports is illustrated in FIGS. 7–9, the invention is not so limited and one or more single outlet ports at different locations along the fuel peg are within the scope of the invention. If the aspect ratio increases, additional outlet ports, that is more than one, in pairs or not, may be provided per channel and evenly spaced across the height H of the channel between the inner and outer rings of any pair of adjacent concentric rings. Of course, a single fuel outlet port or a single pair of outlet ports per channel is within the scope of the invention as well as fuel ports in alternating channels.

Furthermore, each fuel peg is preferably positioned in alignment with at least one vane of one of the stacks. In other stacks, the fuel peg is positioned in between adjacent vanes of at least one of the stacks. This arrangement is depicted in FIG. 6 for example. Other factors that determine the number of fuel outlet ports per peg is the minimum pressure ratio across the fuel peg port and the minimum allowable outlet port diameter required to eliminate the potential for fuel clogging the outlet port. In one example, the minimum diameter desired to prevent plugging ranges from approximately 0.025 inches to approximately 0.030 inches. It should be noted, however, that depending on the particular application and design other ranges are possible.

The premixing system may provide the downstream catalyst with a mixture sufficiently uniform for proper catalyst operation and wide operating limits. Also, modal and thermal stress finite element analyses have been incorporated in the development such that the premixing system design meets life targets. A combination of atmospheric testing and advanced computational fluid dynamics (CFD) analysis in addition to modal stress finite element analyses have been conducted and discussed in an article entitled "Development of a fuel and air mixer for an 11MW gas turbine catalytic combustion system" by Robert Corr, Tim Caron, John Barnes, Stefan Meyer, John Battaglioli, Tom Howell, and Paul Dodge published in the Proceedings of the ASME Turbo Expo 2002 (Paper No. GT-2002–30098), which is in its entirety incorporated herein by reference. The fuel-to-air uniformity at the catalyst inlet was measured to be approximately less than ±7% using the swirler parameters substantially as described for FIG. 14 and axial configuration mixer structures described above. Also, the thermal uniformity at the catalyst was measured to be less than approximately ±25° C. Further, the atmospheric test data and CFD models indicated that the pressure drop across the mixer was less than approximately 0.55% of the compressor discharge pressure.

While the present invention has been described with reference to one or more particular variations, those skilled in the art will recognize that many changes may be made thereto without departing from the spirit and scope of the present invention. Each of these embodiments and obvious variations thereof are contemplated as falling within the spirit and scope of the claimed invention, which is set forth in the following claims.

The invention claimed is:

1. A premixing system for premixing fuel and air prior to combustion in a gas turbine engine that includes a catalyst, comprising:

a mixer housing having a mixer inlet region for receiving air and a diffuser region for diffusing the air;

a fuel inlet system interconnected with the mixer inlet region and located downstream of the mixer inlet region;

a swirler interconnected with the fuel inlet system and located downstream of the fuel inlet system and upstream of the diffuser region;

wherein a flow path is defined by the flow of at least said air entering the mixer inlet region that passes through the fuel inlet system, the swirler, and the diffuser region; and wherein the mixer inlet region includes a contraction region that accelerates the flow of air upstream of the swirler and a catalyst.

2. The premixing system of claim 1 further including a pre-contraction region having a cross-sectional flow area; wherein the contraction region has a cross-sectional flow area that is smaller than the cross-sectional area of the pre-contraction region.

3. The premixing system of claim 1 wherein the contraction region has a cross-sectional flow area that smoothly decreases with distance along the flow path.

4. The premixing system of claim 1 wherein the contraction region is straight-walled.

5. The premixing system of claim 1 wherein the contraction region is curved.

6. The premixing system of claim 1 further including a pre-contraction region having a cross-sectional flow area;

wherein the contraction region has a cross-sectional flow area that is approximately 10% smaller than the cross-sectional flow area of the pre-contraction region.

7. The premixing system of claim 1 further including a center body located along a central axis of the premixing system.

8. The premixing system of claim 1 wherein the premixing system has an axial configuration.

9. A premixing system for premixing fuel and air prior to combustion in a gas turbine engine that includes a catalyst, comprising:

a mixer housing having a mixer inlet region for receiving air and a diffuser region for diffusing the air;

a fuel inlet system interconnected with the mixer inlet region and located downstream of the mixer inlet region;

a swirler interconnected with the fuel inlet system and located downstream of the fuel inlet system and upstream of the diffuser region;

wherein a flow path is defined by the flow of at least said air entering the mixer inlet region that passes through the fuel inlet system, the swirler, and the diffuser region;

wherein the mixer inlet region includes a contraction region that accelerates the flow of air upstream of the swirler; and wherein the premixing system has a radial configuration.

10. The premixing system of claim 9, further including a pre-contraction region having a cross-sectional flow area; wherein the contraction region has a cross-sectional flow area that is smaller than the cross-sectional area of the pre-contraction region.

11. The premixing system of claim 9, wherein the contraction region has a cross-sectional flow area that smoothly decreases with distance along the flow path.

12. The premixing system of claim 9, wherein the contraction region is curved.

13. The premixing system of claim 9, further including a pre-contraction region having a cross-sectional flow area; wherein the contraction region has a cross-sectional flow area that is approximately 10% smaller than the cross-sectional flow area of the pre-contraction region.

14. The premixing system of claim 9, further including a center body located along a central axis of the premixing system.

15. A premixing system for premixing fuel and air prior to combustion in a gas turbine engine that includes a catalyst, comprising:

a mixer housing having a mixer inlet region for receiving air and a diffuser region for diffusing the air and fuel;

a fuel inlet system interconnected with the mixer inlet region and located downstream of the mixer inlet region;

a swirler interconnected with the fuel inlet system and located downstream of the fuel inlet system and upstream of the diffuser region;

wherein a flow path is defined by the flow of at least the air entering the mixer inlet region that passes through the fuel inlet system, the swirler, and the diffuser region; and wherein the diffuser region decelerates the flow of air and fuel subsequent to a catalyst.

16. The premixing system of claim 15 wherein the cross-sectional flow area of the diffuser increases with distance along the flow path toward the catalyst.

17. The premixing system of claim 15 wherein the diffuser region includes a first section, a second section, and an inflection point located between the first section and the second section; wherein the first section forms a first angle with respect to the central axis and the second section forms a second angle with respect to the central axis.

18. The premixing system of claim 17 wherein the first angle is constant and the second angle is constant; the second angle being greater than the first angle.

19. The premixing system of claim 18 wherein the first angle is approximately 10 to 18 degrees.

20. The premixing system of claim 18 or 19 wherein the second angle is approximately 30 to 45 degrees.

21. The premixing system of claim 17 wherein the distance from the swirler exit to the inflection point is L1 and the distance from the swirler exit to the catalyst inlet is L2 and $$0.5 \leq \left(\frac{L1}{L2}\right) \leq 0.75.$$

22. The premixing system of claim 15 wherein the premixing system has an axial configuration.

23. The premixing system of claim 15 wherein the premixing system has a radial configuration.

24. The premixing system of claim 15 further including a center body located along a central axis of the premixing system.

25. A method for premixing fuel and air prior to combustion in a catalytic combustor, comprising the acts of:

accelerating a flow of air;

adding fuel to the accelerated flow of air; and creating a swirling motion to the accelerated flow of air to promote mixing of the accelerated flow of air and the fuel prior to reaching a catalyst.

26. The method of claim 25, wherein the act of accelerating the flow of air includes passing the air through at least a portion of a housing with a decreasing cross-sectional area.

27. The method of claim 25, further including the acts of decelerating the mixture of air and fuel subsequent to the act of creating a swirling motion.

28. The method of claim 27, wherein the act of decelerating the mixture of air and fuel prior to reaching a catalyst includes passing the mixture of air and fuel through at least a portion of a housing with an increasing cross-sectional area.

29. The method of claim 25, wherein the act of adding fuel to the accelerated flow of air includes jetting fuel at a substantially normal angle to the direction of the flow of air.

30. The method of claim 25, wherein the act of creating a swirling motion includes creating counter-rotating flows of different portions of the flow of air in substantially tangential directions.

31. A method for premixing fuel and air prior to combustion in a catalytic combustor, comprising the acts of:

providing a flow of air;

adding fuel to the flow of air;

creating a swirling motion to the flow of air to promote mixing of the accelerated flow of air and the fuel; and decelerating the flow of air and fuel prior to reaching a catalyst.

32. The method of claim 31, wherein the act of decelerating the flow of air and fuel includes passing the air through at least a portion of a housing with an increasing cross-sectional area.

33. The method of claim 31, further including the acts of, accelerating the air subsequent to the act of adding the fuel.

34. The method of claim 33, wherein the act of accelerating the flow of air prior to adding the fuel includes passing the mixture of air and fuel through at least a portion of a housing with a decreasing cross-sectional area.

35. The method of claim 31, wherein the act of adding fuel to the accelerated flow of air includes jetting fuel at a substantially normal angle to the direction of the flow of air.

36. The method of claim 31, wherein the act of creating a swirling motion includes creating counter-rotating flows of different portions of the flow of air in substantially tangential directions.

* * * * *